US006088008A

United States Patent [19]

Reeder

[11] Patent Number: 6,088,008

[45] Date of Patent: Jul. 11, 2000

[54] APPARATUS AND METHOD FOR REMOTELY CONTROLLED VARIABLE MESSAGE DISPLAY

[76] Inventor: Bruce B. Reeder, 4155 Brigadoon La., Colorado Springs, Colo. 80909

[21] Appl. No.: 08/224,202

[22] Filed: Apr. 14, 1994

[51] Int. Cl.[7] ..... G09G 3/04

[52] U.S. Cl. ..... 345/33; 340/825.07; 40/447

[58] Field of Search ..... 40/447–463; 340/825.07, 340/825.15, 825.54; 345/33, 1–3; 235/383; 370/82; 343/703

[56] References Cited

U.S. PATENT DOCUMENTS

| | | | |
|---|---|---|---|
| 4,410,889 | 10/1983 | Bryant et al. | 370/82 X |
| 4,500,880 | 2/1985 | Gomersall et al. | 40/448 X |
| 4,766,295 | 8/1988 | Davis et al. | 235/383 |
| 4,888,709 | 12/1989 | Revesz et al. | 340/825.07 X |
| 4,937,586 | 6/1990 | Stevens et al. | 343/702 |

FOREIGN PATENT DOCUMENTS

| | | | |
|---|---|---|---|
| 2164189 | 3/1986 | United Kingdom . | |
| 8903571 | 4/1989 | WIPO | 340/825.54 |

*Primary Examiner*—Kent Chang
*Attorney, Agent, or Firm*—Timothy J. Martin; Michael R. Henson; Mark H. Weygandt

[57] ABSTRACT

A variable message display sign comprises a plurality of interchangeable character displays each having a plurality of signal elements organized in distinct sets, with each signal element having an on state and an off state. A controller is located remotely of the character displays and produces an address signal containing character address data for identifying an addressed character display which resides at a desired address location within the message display sign. The controller also produces a set signal containing set address data for identifying an addressed set of signal elements and a data signal containing display data corresponding to desired on/off states for each signal element in the addressed set. A logic circuit is associated with each character display and has a unique character address. Each logic circuit is secured to a respective one of the character displays and has a memory operative in response to the address signal to receive and store the display data according to the set address data for an addressed set of signal elements. The logic circuit accordingly switches the signal elements of its associated character display to a desired pattern of on/off states according to the display data stored in memory, thereby to display a desired character irrespective of which one of the plurality of character displays resides at the desired address location. A data bus interconnects the controller and the logic circuits whereby the character address data, the set address data and the display data are communicated. A method is also provided for controlling a plurality of interchangeable character displays.

22 Claims, 8 Drawing Sheets

APPARATUS AND METHOD FOR REMOTELY CONTROLLED VARIABLE MESSAGE DISPLAY

FIELD OF THE INVENTION

The present invention is broadly directed to message signs for conveying information. More particularly, however, the present invention concerns message signs that have variable characters so that difference messages may be presented on the same sign. Specifically, this invention is directed to remotely controlled variable message signs.

BACKGROUND OF THE INVENTION

The utility of variable message display signs since such signs allow a user to display combinations of various visual symbols and characters in order to create different messages for communication to observers. Some variable message signs employ rotating members or drums which have a plurality of facets which can be placed in registration with one another to provide a desired message. These facets may contain characters in the form of letters or numerals, or alternatively, can present pectoral or graphic segments which create an overall image.

Another type of variable sign is known as a scroll sign wherein a pair of rollers have a message web wound thereon so that different messages may be scrolled with respect to a view area thereby providing different messages on the exposed portion of the web. The message web may alternatively carry an entire message which is scrolled into position, or be formed as a module so that each scroll module presents a character in the form of a numeral or letter. A plurality of such modules may then be organized so that a wide variety of different messages can be presented. One such example of a scroll module and sign system utilizing this scroll technique is described in U.S. Pat. No. 4,680,883 issued Jul. 21, 1987 to Stadjuhar et al. and owned by the Assignee of the present invention.

A still further type of variable sign wherein a plurality of character displays are provided to present either a letter of numeral characters organized as a message are known as matrix display devices. In such devices, a plurality of signal elements are organized in a matrix and are used to produce either numerals, letters or both, according to command instructions in order that a desired message is displayed. A wide variety of signal elements may be used in such matrix displays. For example, an electromagnetic shutter device is described in U.S. Pat. No. 3,975,728 issued Aug. 17, 1976 to Winrow. In such device, a rotatable element is moved between two positions by electromagnet. In one position, the element corresponds to an "off" state while in the other position corresponds to a "on" state for the associated pixel in the matrix. U.S. Pat. No. 4,040,193 issued Aug. 9, 1977 to Matsuda et al. discloses a shutter type signal element wherein the shutter member is rotated between two position to expose two different colors. U.S. Pat. No. 4,163,332 issued Aug. 7, 1979 to Salam discloses yet another type of shutter device that may be used in a matrix display.

In addition to the above described shutter type matrix devices, it is known to use lighting elements, such as lightbulbs, light emitting diodes or groups of bulbs or diodes to form a pixel for a matrix display. In such devices, no shutter masking is utilized; rather, each individual signal element, whether a lightbulb, diode array or the like, it is selectively powered between the off state and the on state so that the pattern of pixels in the on state generate the desired character. It is also known in such devices to use other types of signal elements, such as liquid crystal displays, magnetic fluid devices, etc. to create a desired character.

Yet other variable signs employ a different type of matrix arranged to produce a numeral, a letter or both. Here, a rectangular perimeter is typically formed of a plurality of character segments, and character segments extend medially between the opposed sides of the rectangular and, if desired, diagonally. By selectively placing desired segments in the "on" state, a selected numeral, or letter (depending upon the character design) can be presented. One example of a numeric display is described in U.S. Pat. No. 4,496,945 issued Jan. 29, 1985 to Stadjuhar et al. and assigned to the Assignee of the present invention. U.S. Pat. No. 3,273,270 issued Sep. 20, 1966 shows a segmented display module using a shutter system to produce numerals or letters. Here again, various types of magnetic or mechanical shutters may be employed, numerous devices such as lightbulb and light emitting diodes may be used, liquid crystal displays employed, or other types of changeable signal elements employed, all as known in the art.

Due to the existence of these known techniques for producing variable displays, it is highly desirable to remotely control the message presented thereon. Thus, for example, a central command station may be able to communicate with distantly located controllers for respective signs in order to demand those controllers to change their associated character displays to a selected message. The display characters, themselves, may be remote from their respective controller such as occurs in a sign that is elevated with the controller therefor being located on the ground surface.

The present invention relates to a control system interfacing such a controller located remotely from its associated character displays. It should be appreciated that the variable message display sign according to the present invention is directed to the control of character displays of the matrix type wherein a plurality of pixels or segments are selectively actuated to form the desired display. This invention may be employed with character displays having signal elements defining the pixels therefore, where such pixel elements or any type known in the art or hereinafter developed and where such signal elements can switch between the on state and off state to display the desired message.

SUMMARY OF THE INVENTION

It is an object of the present invention to provide a new and useful variable message sign which may be remotely controlled to display different desired messages.

Another object of the present invention is to provide a variable message sign that eliminates complex and bulking wiring.

A further object of the present invention is to provide a variable message sign that is easy to service.

Yet another object of the present invention is to provide a variable message sign having feedback capability so that the status of the displayed characters may be remotely monitored.

Still a further object of the present invention is to provide a variable message sign having character displays that includes control logic and memory to form a unitary character module.

Yet a further object of the present invention is to provide a variable message sign that conserves resources not only in construction and maintenance but also in operation by having a controllable duty cycle.

According to the present invention, then, a variable message sign is provided to be operative with a power source in order to display a variable message. Broadly, the variable message display sign includes a plurality of character displays each having a plurality of signal elements organized in a plurality of distinct sets with each signal element having an on-state and an off-state so that the pattern of signal elements which are placed in the on and off states form a message character. A controller is located remotely from the character displays and is operative to produce data that determines the character image on each of the character displays. More particularly, the controller produces an address signal containing character address data for identifying an addressed character display, a set signal containing set address data for identifying an address set of signal elements and a data signal containing display data corresponding to the desired on/off states for each signal element in the addressed set. A logic circuit is associated with each of the character displays and is located proximately to a respective character display. The logic circuit has a unique character address and has a memory operative in response to an address signal containing character address data corresponding to its unique character address to receive and store the display data according to the set address data for an addressed set of signal elements. The logic circuit is used to switch the signal elements of its associated character display to a desired pattern of on/off states according to the display data stored in its memory. A data bus interconnects the controller and the logic circuits so that the character address data, the set address data and the display data are communicated to the logic circuits.

In its more specific form, the signal elements of each character display of the variable message display sign are organized as a matrix having rows and columns and may be light-emitting diodes, liquid crystal, shutter elements, electric bulbs or other such signal elements. Preferably, these signal elements are light-emitting diodes which are directly mounted to the front surface of a support panel so that the diode leads are directly secured to the support panel. The diodes define pixels for the character display in the form of a seven × five matrix. Each pixel also comprises a plurality of light-emitting diodes organized in an array of rows and columns and then at least two different groups which are electrically connected in parallel to one another with light-emitting diodes in each respective group electrically connected in series with one another. The light-emitting diodes in each array forming the pixel is arranged so that there is at least one light-emitting diode from each of the groups in each of the array rows and in each of the array columns. A monitoring element is also preferably associated with each respective element and operates to monitor the on/off state thereof to produce a feedback signal indicating its on/off state. Here, also, the data bus operates to communicate the feedback signals to the controller. Moreover, each of the character displays also includes a display switch which is operative to activate the respective character displayed by switching the power source on and off for a selected duration and frequency.

It is preferred that the unique address for each character displayed be "hard-wired ". Here, interconnect cables are provided for each character display to interconnect its associated logic circuit up to the data bus. Each interconnect cable then terminates in a first connector that is releasably connected to a second connector associate with a respective logic circuit, and the interconnect cable is hard-wired with the unique character address corresponding to the character display so that whatever logic circuit is connected thereto will reside at the unique character address of the interconnect cable. To this end, each character display is preferably formed as a module which comprises a support panel supporting the signal elements and a logic circuit board disposed on and supported by the support panel as a unit with the logic circuit being formed on the logic board. By hardwiring the connectors to the logic circuits, the display modules may be interchanged without violating the integrity of the addressing system.

Accordingly, each logic circuit employs an address comparator which compares the unique address (e.g., the hardwire address of its connector) with the address data generated by the controller and present on the data bus. At such time that the addresses match, the comparator generates a match signal which is provided to a decoder which selectively generates an input enable signal corresponding to the set data (e.g., column data in the display matrix). A data latch is associated with each column of the display of each character so that, when a respective data latch receives it corresponding input enable signal from the decoder, the data latch operates to latch the display data on the data bus. When there is no match between the unique address of the logic circuit and the address carried on the data bus, the logic circuit generates an output enable that is directed to each of the data latches thereby causing them to switch the signal elements of the associated character display to the desired pattern of on/off states. Preferably, the duty cycle of the activation of the character display may be controlled by a pulse width signal carried on the data bus and communicated to a switch device which switches the power source to the character display at the duration and frequency of the pulse width signal which is generated by the controller.

Where monitoring elements are provided to test the integrity of the display, individual ones of the data latches are sequentially provided with an output enable signal after the data latch has been loaded with the display data so that the feedback signals from the corresponding monitoring elements of the corresponding set of signal elements may be feedback to the controller which can compare the actual display output with the intended display output to determine if there is a message error.

The controller is preferably microprocessor controlled and, itself, is interconnected to a communication system so that it may receive instructions therefrom from a remote control station. Typically, this is accomplished over commercial telephone lines. In any event, the controller presents the character address data, the set address data and the display data in a timed manner controlled by a strobe pulse. In the presence of a strobed pulse, the logic circuit compares the character address data to determine which logic circuit is addressed, decodes the set address data where it is the addressed logic circuit and causes the appropriate data latch to latch the display data. In the absence of the strobe pulse, the controller reconfigures the data on the data bus so that when display data is provided to a different data latch in an addressed logic circuit or to an entirely different logic circuit at a different character address.

According to the general method of the present invention, a method for controlling a plurality of character displays is provided wherein each character display has a plurality of signal elements that are individually switchable between on and off states in order to produce a pattern of a desired character. These signal elements are organized in a plurality of sets, and the method comprises the control of these signal elements. The method includes the first steps of providing a logic circuit proximate to each character display with each logic circuit including a memory operative to store display data for each of the associated signal elements of each of its associated sets, providing a unique address for each such logic circuit, providing a controller for each logic circuit located remotely thereof and interconnecting the logic circuits and the controller by means of a common bus. The method further includes the step of placing a character address on the bus and comparing the character address with the unique addresses for each logic circuit so that an addressed one of the logic circuits is placed in a condition to receive display data with remaining ones of the logic circuits inhibited from receiving display data. A set address is also placed on the bus to identify a selected one of the sets of signal elements so that the memory associated therewith is placed in a condition to receive the display data with all other memories of the address logic circuit being inhibited from receiving display data. Also, display data is placed on the bus corresponding to each of the signal elements of the selected set, and the display data is loaded into the memory associated with the selected set of the address logic circuit. The steps of placing character address data, set address data and display data on the bus is then repeated until the memories of all of the logic circuits are loaded with display data for their respective character displays. Said character displays are, of course, powered so that the signal elements thereof are switched to display the pattern according to the display data.

Preferably, the steps of placing the character address, the set address and display data occurs simultaneously, and the method includes the step of providing a clock or strobe pulse which causes the data to be processed as described above. In between the clocking pulses, the controller acts to vary the display data as needed and the addressed logic circuit and/or set of signal elements. The method can include the inhibiting of any display of data by the character display associated with the addressed logic circuit. Also, the method may include the feedback to the controller of feedback test data wherein the integrity of the display pattern for each set of signal elements is compared with the intended display data for the signal elements of the selected set. Preferably, the method includes the step of loading display data for one set of signal elements while testing the data previously loaded for another set of signal elements. This method may also include any step inherently practiced by the apparatus and control circuitry described herein.

These and other objects of the present invention will become more readily appreciated and understood from a consideration of the following detailed description of the exemplary embodiments when taken together with the accompanying drawings, in which:

DETAILED DESCRIPTION OF THE EXEMPLARY EMBODIMENT

A. General Introduction

The present invention is directed to a variable message display sign which is operative to display a message which may be selectively varied. Generally, a variable message display sign employs a plurality of character displays each having a plurality of signal elements which may be selectively placed in an on and off state to display a character or image on the character display, and this selective switching of the signal elements is accomplished by means of a controller and logic circuit which process information received by the controller in the form of the desired message to be displayed in order to drive the signal elements to produce the desired message. The present invention departs from pre-existing systems by eliminating substantial and complex wiring distinctly interconnecting each signal element with the controller by placing a logic circuit in proximity to each character display and by having a remotely located controller sequentially address desired ones of the logic circuits by means of a data bus.

Figure 1:
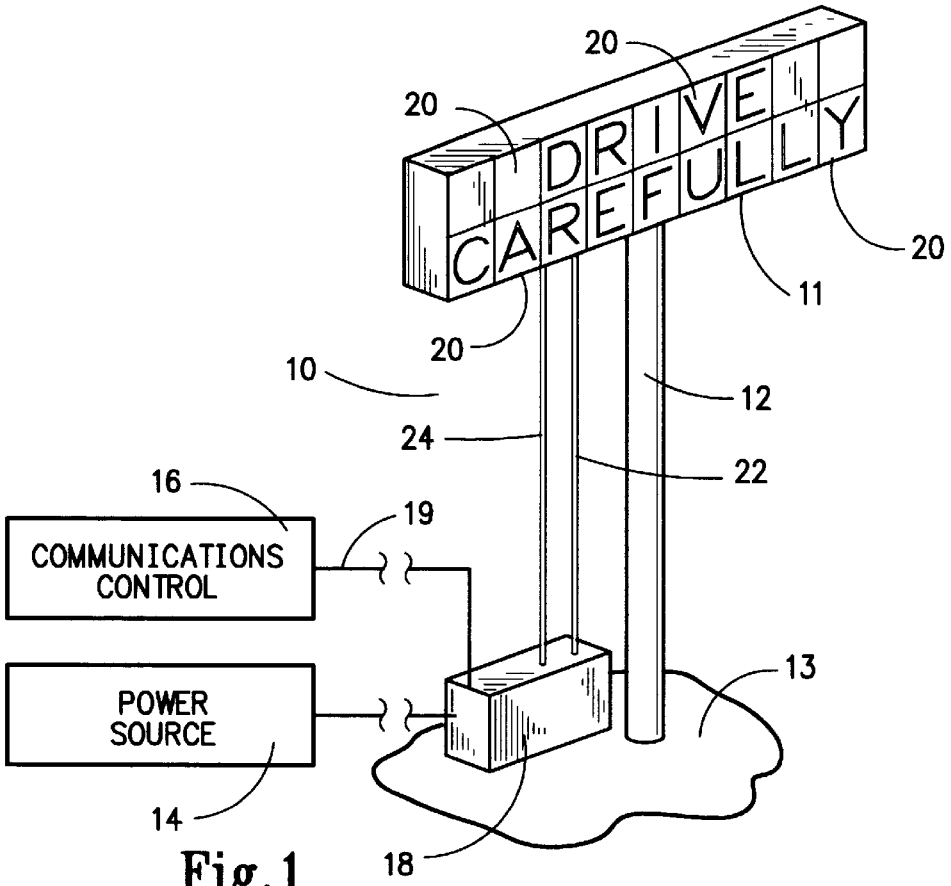
FIG. 1 is a perspective view of a representative variable message display sign according to the exemplary embodiment of the present invention.

An exemplary embodiment of the physical appearance of such a sign may be seen in FIG. 1 wherein the variable message display sign 10 includes a sign housing 11 supported on a surface 13, such as the ground, by means of a support post 12. Sign 10 includes a plurality of character displays 20 in housing 11, and character displays 20 operate to selectively display a desired character to present the desired message. Variable message display sign 10 includes a controller 18 located remotely of character displays 20 and may conveniently be located on surface 13, for example, adjacent to the base of post 12. A power source 14 is connected to a controller 18, and power is supplied to characters 20 by means of a power supply cable 22. Controller 18 also supplies control data to character 20 over a data bus 24. If desired, and is shown in FIG. 1, controller 18 may communicate with communications control 16, for example, over telephone lines 19 in a manner well known in the art. Communications control 16 can be a centralized control office for multiple signs and is typically located distantly from variable message display sign 10, but this is not of course a required feature of the broad form of the present invention. It may be noted in reference to FIG. 1, that a signal data bus 24 is used for all of characters 20, and this feature of the present invention will be described in much greater detail, below.

In FIG. 1, it may also be seen that variable message display sign 10 is depicted as a traffic warning sign, although it should be understood at the outset that the present invention is in no way limited to traffic control but can be used in any circumstance where a variable message is desired to be presented to a viewer. For illustrative purposes, then, it may be appreciated that a traffic controller may be located at a centralized office and may communicate with a plurality of controllers 18 for a variety of respective signs 10 and, by establishing a communications link over telephone lines 19, can instruct each respective controller 18 to display a respective message on its associated variable message display sign 10. Moreover, communication lines 19 can be used to receive feedback information to validate the integrity of the displayed message, as hereinafter described.

B. Prior Art Techniques

Figure 2:
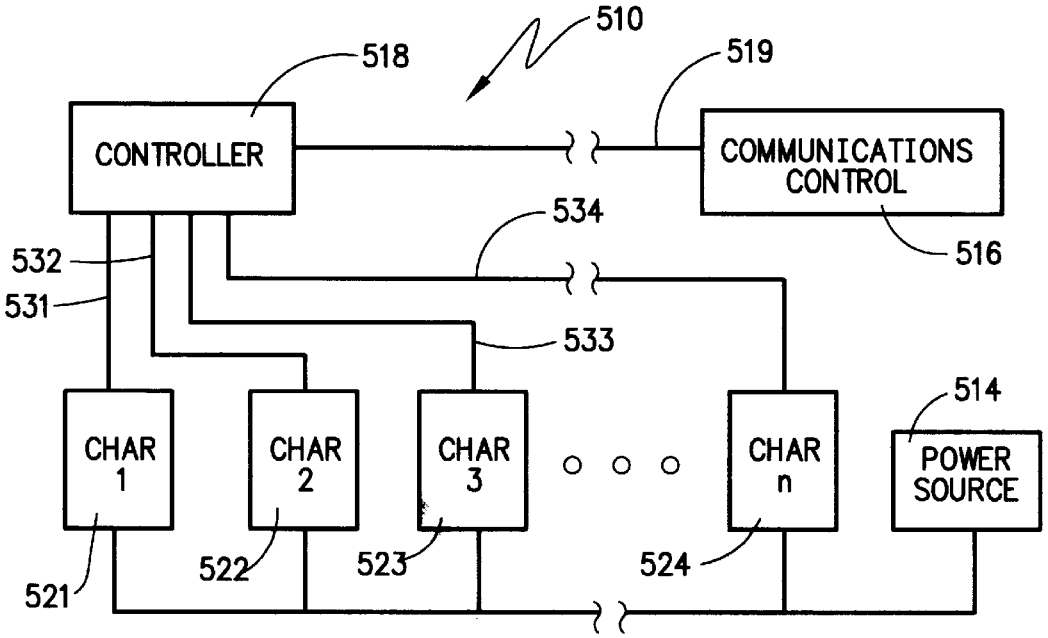
Fig.2 (PRIOR ART)
FIG. 2 is a diagrammatic view of a variable message display sign according to the prior art.

In order to understand the departures of the present invention from the existing prior art, it is helpful to review the primary features of the prior art as it relates to variable message display signs. With reference to FIG. 2, then, a typical prior art variable message display sign 510 employs a controller 518 to individually drive characters 521–524 which are powered by power source 514. In the prior art, the number of character displays is selected to be an adequate number for the maximum length of message to be displayed. Controller 518 may receive control or command communications from communications control 516 located distantly therefrom, again for example, over communication lines 519. In any event, controller 518 has a plurality of data buses in one-to-one correspondence with the display characters such as data buses 531–534, respectively associated with characters 521–524. Power is supplied from power source 514.

Figure 3:
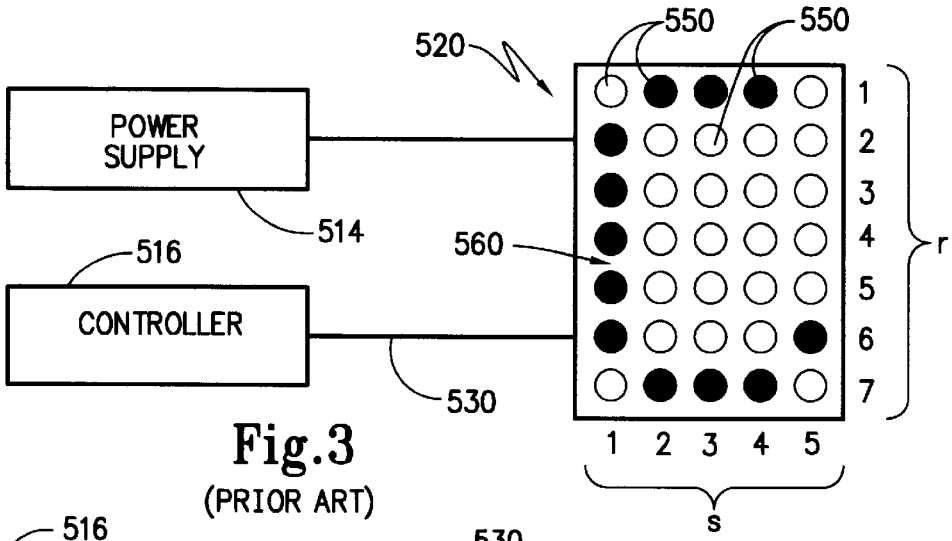
Fig.3 (PRIOR ART)
FIG. 3 is a diagrammatic view showing a representative character display according to the prior art.

As is shown in FIG. 3, the prior art display such as a representative character display 520 is in the form of a matrix 560 of signal elements 550 organized in an r × s matrix of "r" rows and "s" columns. Typically, in the prior art, such a matrix 560 is a 7×5 matrix of signal devices each of which forms a pixel for the character display. These signal elements are known to include a variety of type of structures such as light bulbs, light-emitting diode arrays, shutter devices, liquid crystals, and the like. In any event, as is shown in FIG. 4, each signal element 550 is connected between a voltage or power source 514 to ground with respective signal element being in series with a switch 580 so that placing a switch 580 in a closed condition connects the circuit through the corresponding signal element to turn it into an on-state while an open condition for switch 580 leaves its respective signal element 550 in an off-state.

Figure 4:
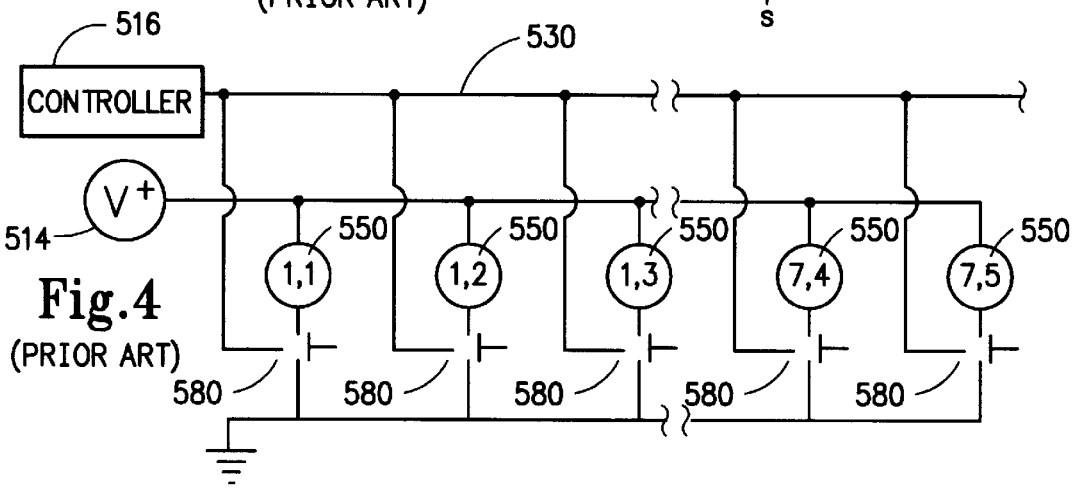
Fig.4 (PRIOR ART)
FIG. 4 is a diagrammatic view showing the control and switching system according to the prior art and used with the character display of FIG. 3.

Thus, as is shown in FIG. 4, switches corresponding to signal elements 1,2 1,3 and 7,4 are closed while switches corresponding to signal elements 1,1,1 and 7,5 are open to correspond to the respective signal elements located at those row and column positions. Accordingly, with reference to FIG. 3, to display the character "C" selected signal elements are in the on-state with the remaining signal elements being in the off-state. The on-state signal elements for the character "C" are: 1,2; 1,3; 1,4; 2,1; 2,5; 3,1; 4,1; 5,1; 6,1; 6,5; 7,2; 7,3; and 7,4.

According to the prior art, the representative data bus 530 for each pixel typically includes a discreet wiring connector interconnecting each respective signal element 550 to controller 516 so that, with reference to FIGS. 3 and 4, thirty-five such wiring connectors 590 would be used to control a single character 520. Where a variable message display sign has ten characters, this would result in the use of three hundred fifty lead wires to communicate the information to each pixel on a one-to-one correspondence. This wiring is accordingly complex, expensive and difficult to maintain.

Figure 5:
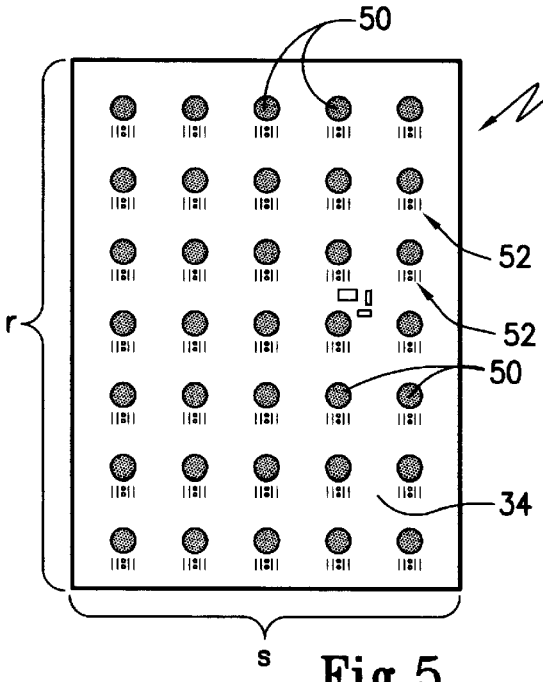
FIG. 5 is a front view in elevation showing the character display module according to the exemplary embodiment of the present invention.
Figure 6:
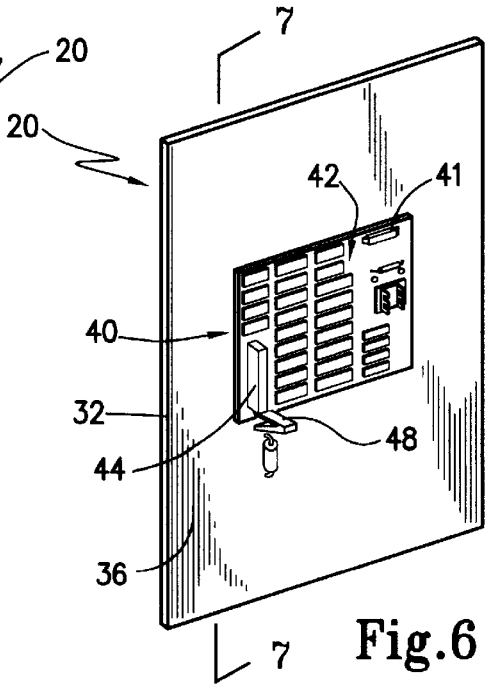
FIG. 6 is a rear perspective view of the character module shown in FIG. 5.
Figure 7:
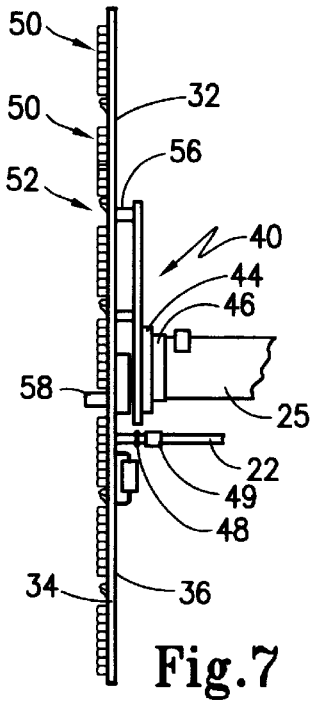
FIG. 7 is a cross-sectional view taken about lines 7—7 of FIG. 6 and including the power and data bus interconnect thereto.

C. Physical Structure of the Character Display According to the Exemplary Embodiment of the Present Invention According to the present invention, then, an improved character display is provided as shown in FIGS. 5–11 and the simplified physical structure of the variable message display sign is diagramed in FIG. 12 with the data bus shown in FIG. 13. With reference to FIGS. 5–7, it may be seen that character display 20 (used in sign 10 of FIG. 1) includes a support panel 32 having a front surface 34 and a rear surface 36. Support panel 32 supports a plurality of signal elements 50 which are disposed on the front surface 34 with these signal elements 50 being preferably arranged in a matrix of seven rows "r" and five columns "s". Also as described more thoroughly below, each signal element 50 has feedback circuit elements 52 associated therewith in one-to-one numerical correspondence.

With reference to FIGS. 6 and 7, it may be seen that a logic circuit 40 is formed on circuit board 41 that is mounted to and supported by support panel 32 in spaced parallel relation to rear surface 36 at a central portion of support panel 32. Logic circuit 40 includes a plurality of logic components 42 and a connector 44 to interconnect a logic circuit to mating connector 46 on data bus 24. A power connector 48 is also disposed on rear surface 36 of panel 32 and cooperates with a connector 49 on power supply cable 22 which is preferably set at twenty-four volts DC. Printed circuitry (not shown) may be disposed on support panel 32, preferably on rear surface 36, to interconnect the electric components mounted thereto.

Figure 8:
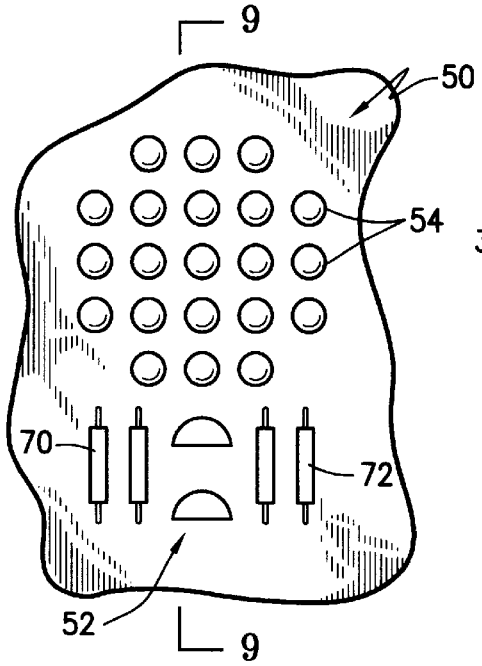
FIG. 8 is an enlarged front view in elevation showing a light-emitting diode array defining a pixel for the character display of FIGS. 6–8.
Figure 9:
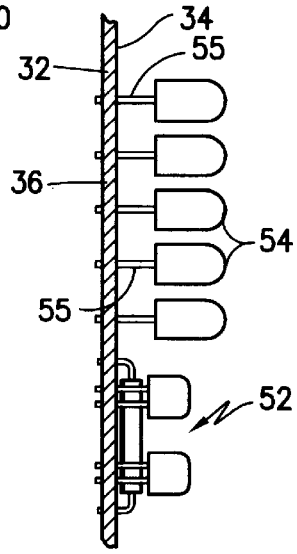
FIG. 9 is a cross-sectional view taken about lines 9—9 of FIG. 8.

A representative signal element 50 is shown in FIGS. 8 and 9 where it may be seen that each signal element includes an array of light-emitting diodes 54 which are organized in rows and columns and have their diode leads 55 directly wired to support panel 32 which, as noted above, is in the form of a circuit board that provides the electrical interconnects between diodes 54 forming the signal elements 50 and connects logic circuit board 41 by means of multi-pin connects 56 and 58, shown in FIG. 7.

Figure 10:
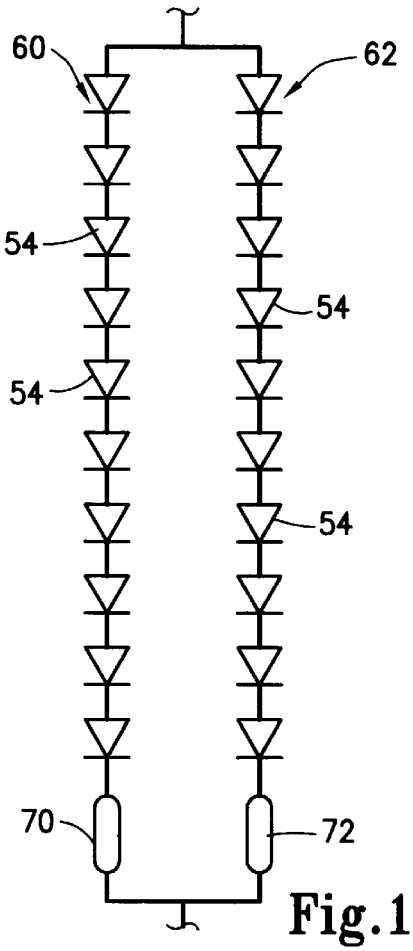
FIG. 10 is a diagrammatic view of a pair of diode strings used to form the diode array of FIGS. 8 and 9.
Figure 11:
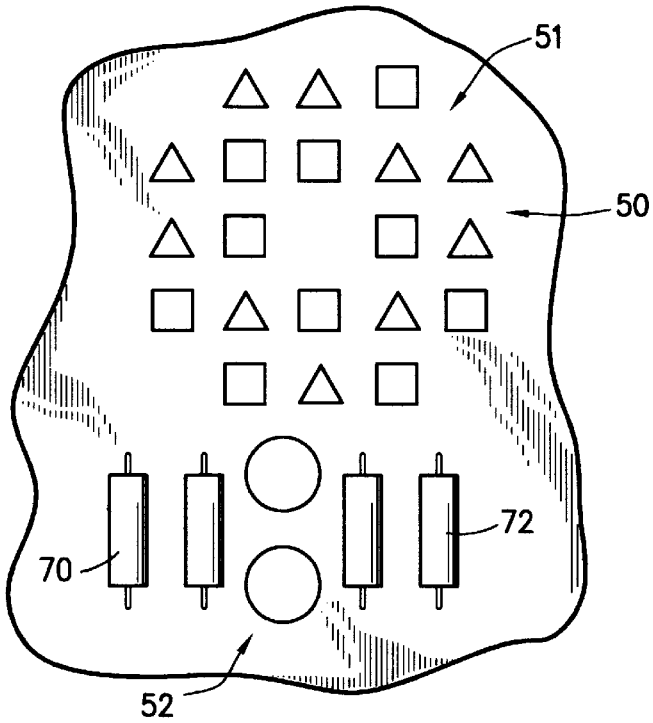
FIG. 11 is a diagrammatic view similar to FIG. 8 but showing the physical arrangement of the diode strings of FIG. 10.

With reference to FIGS. 10 and 11, it may be seen that diodes 54 are preferably organized in at least two strings or groups 60 and 62 wherein the respective diodes 54 are electrically connected in series with one another and with a respective 191 ohm resistors 70 and 72. Resistors 70 and 72 are selected according to the characteristics of diodes 54 in order to regulate the current through the signal circuit (e.g., the diode strings) to help stabilize the current. Each of groups 60 and 62 are electrically connected in parallel with one another so that, if one diode 54 burns out and creates an open circuit, the respective pixel will remain operable but with less intensity. Diodes 54 in groups 60 and 62 are arranged, as is shown in FIG. 11, so that there is at least one group 60 diode and at least one group 62 diode in each row of the array 51 and at least one group 60 diode and at least one group 62 diode in each column of array 51. Thus, for representative purposes in FIG. 11, the group 60 diodes are represented by squares and the group 62 diodes are represented by triangles.

Figure 12:
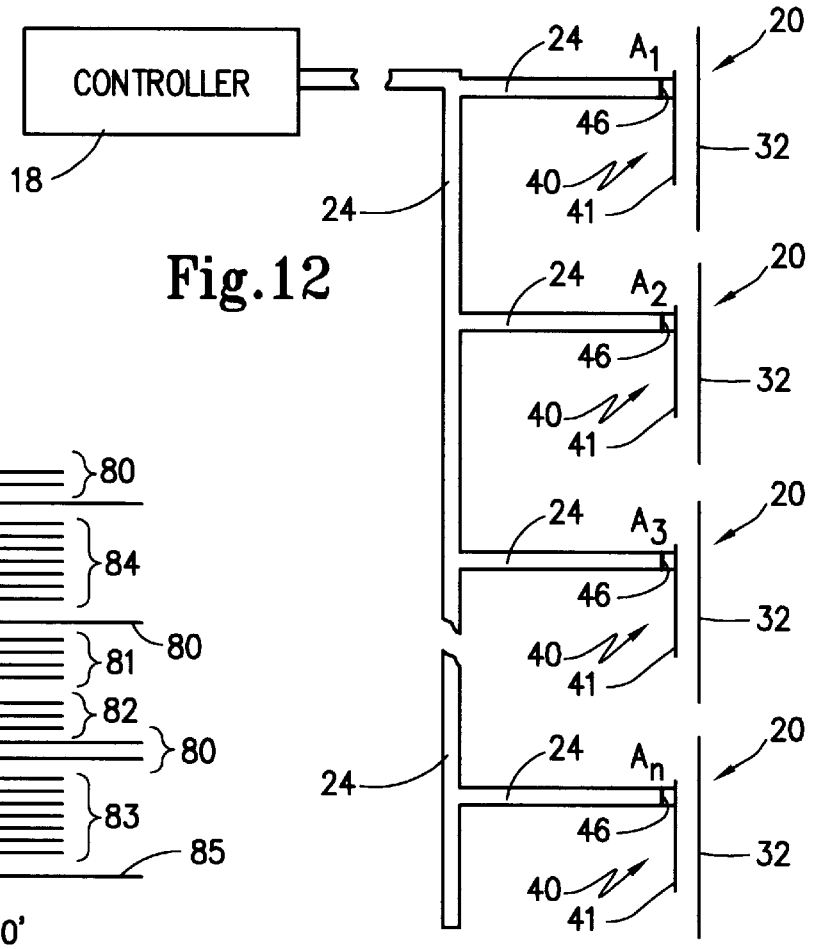
FIG. 12 is a simplified diagrammatic view showing the interfacing of a plurality of display modules, such as those shown in FIGS. 5–7, connected by means of a data bus to a controller according to the exemplary embodiment of the present invention.

Turning to FIG. 12, it may be seen that the controller 18 is interconnected to each character display 20 by means of a simple data bus 24 which mounts the connectors 46 that are securable to respective logic circuit boards 41 of logic circuits 40 at respective addresses $A_1, A_2, A_3, \ldots A_n$. Since it is desirable that each of character display 20 be identical, the unique character address $A_1, A_2, A_3, \ldots A_n$ is hard-wired by each interconnect cable 24 and it associated connector 46, as described more thoroughly below, although other address techniques may be implemented without departing from the scope of the present invention. Moreover and as described below, controller 18 operates to sequentially and selectively address the logic circuits, the character displays residing at each individual address so as to load those logic circuits with the display data corresponding to the desired character to be displayed by the respective character display.

Figure 13:
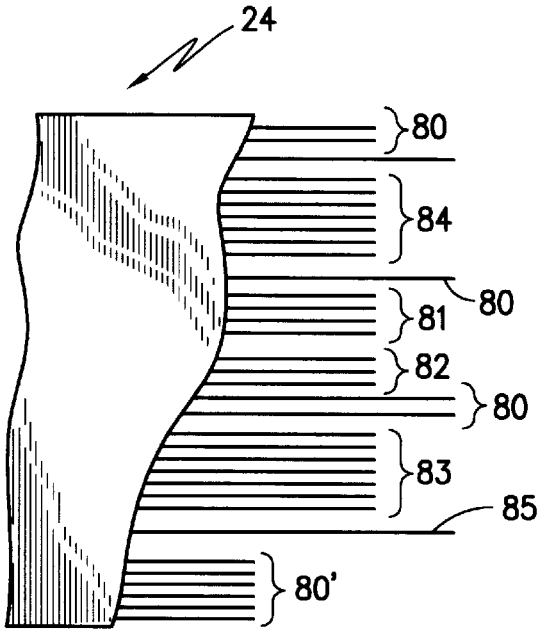
FIG. 13 is a side view, partially broken-away, of the cable forming the data bus of FIG. 13.

The structure of data bus 24 is best shown , in FIG. 13 where it may be seen that data bus 24 includes a plurality of wire leads for carrying control signals, data signals, feedback signals and ground connections. With reference to FIG. 13, it may be seen that grounding wires 80,81' provide an electrical ground for data bus 24 and for the hard wiring of the character addresses while five wires 81 form an address bus for addressing a selected one of the character displays and three wires 82 form a column select bus for carrying column address data. Seven wires 83 define a data bus for carrying display data. Seven wires 84 form a feedback bus. Finally, wire 85 carries a clock or strobe pulse while wire 86 carries a pulse width modulation pulse for controlling the duty cycle of each character display. It should be understood that the number of grounding wires, address wires, data wires, feedback wires and the pulse-width modulation may be changed according to the needs of a particular variable message display signal. Moreover, certain features are optional without departing from the broad scope of this invention. For example, if duty cycle control is not desired, the pulse-width modulation wire 86 may be eliminated entirely. Address wires 81 may be increased or decreased based upon the number of character displays desired to be controlled by controller 18. With five such wires 81, of course, thirty-two ($2^5$) display panels may be addressed. Similarly, the number of wires in the column bus may be varied depending upon the number of columns in the character display matrix. Where three column wires are provided, eight ($2^3$) columns can be addressed. The data wires 83 are in one-to-one numerical correspondence with the number of rows in the matrix for the character display as are the feedback wires 84. Of course, if no feedback capability, described below, is desired, feedback wires 84 may be eliminated entirely. Where feedback is provided, the number of wires 84 should equal the number of wires 83 for carrying feedback data in one-to-one correspondence with the row data.

D. Control and Logic Circuits

Figure 14:
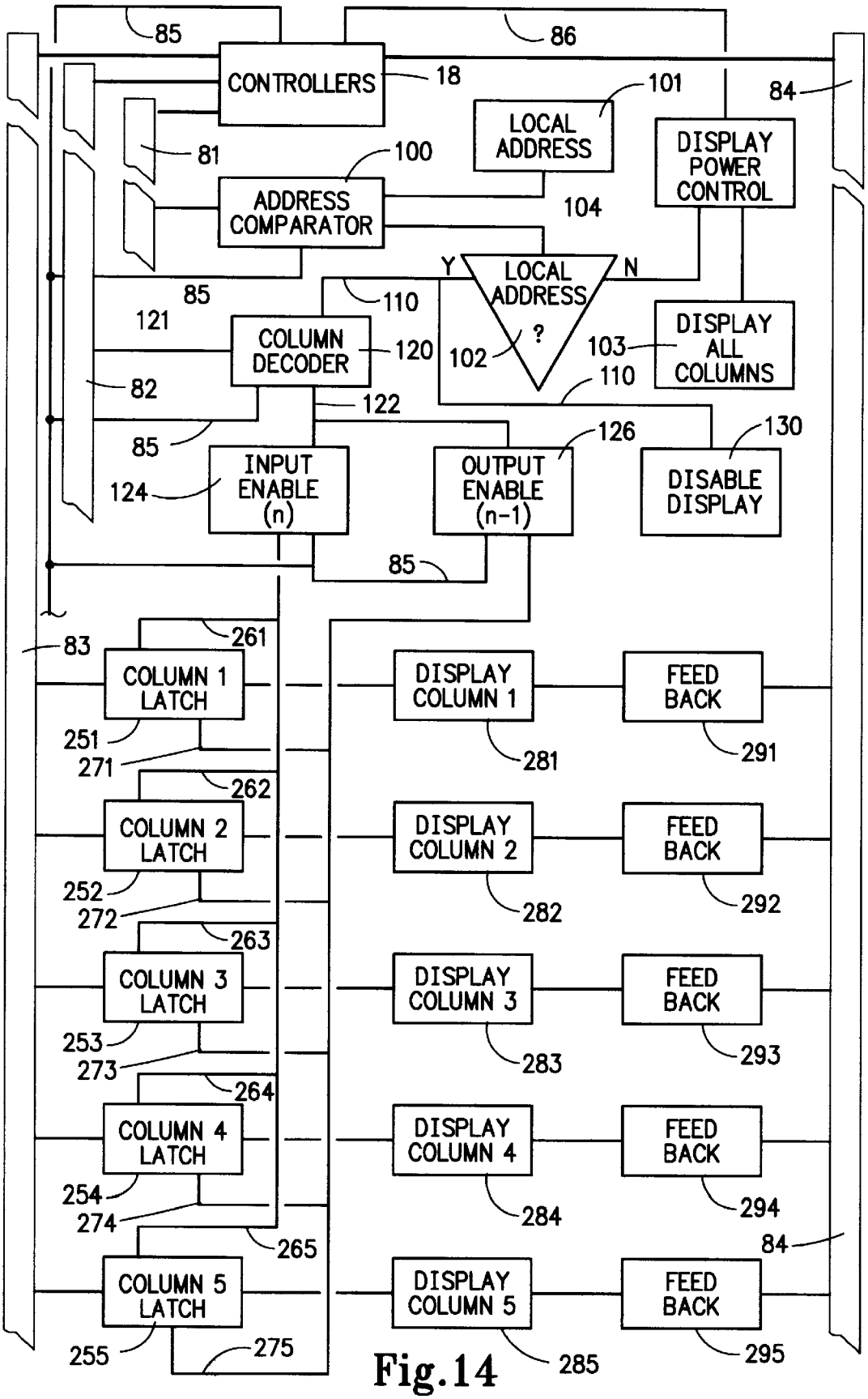
FIG. 14 is a diagrammatic view showing a representative logic circuit according to the present invention.

The overall control and logic circuits for variable message display sign 10 is diagramed in FIG. 14. Here, it should be appreciated that controller 18 is located remotely from the character displays and is operative to produce an address signal containing character address data for identifying an addressed character display so as to eliminate the need to provide individual electric leads to each pixel. This address signal is carried by address bus 81 which is connected to an address comparator 100 which receives, as its inputs, the address carried by address bus 81 and a local address 101 corresponding to the unique local address for its respective character display. Upon the occurrence of a strobe pulse on strobe wire 85, address comparator 100 compares the local address and the address data to see if they match, as is shown in block 102. If the character address data on address bus 81 does not match the local address, all pixel columns of the associated character display are activated for display, as at 103, according to the display power control 104 which in turn is governed by the pulse-width modulation signal on lead 86. However, where a match occurs between the local address and the address data, address comparator 100 recognizes that its logic circuit and the associated character display are being addressed by controller 18 and generates a match signal at 110 that is transmitted to column decoder 120. Disable display 130 operates to generate a disable signal preventing the signal elements on the associated character display 20 from reacting to changes in row and column display data, other than as may occur during feedback testing described below.

Controller 18 generates a set signal containing set address data for identifying an addressed set of signal elements, such as a selected column, and this set signal is input to column decoder 120. Upon receipt of a strobe pulse from strobe 85 and in the presence of match signal 110, column decoder decodes the binary column information from column select bus 82 at 121 to produce an enable signal 122 which is presented to an input enable 124 and an output enable 126. Input enable 124 produces an input enable signal for column latches 251, 252, 253, 254 and 255 according to the column data carried by data bus 82. Thus, for example, if column address data corresponding to column three is carried on columns selected bus 82, column decoder 120 and input enable 124 enable the input 263 of column latch 253 so that latch 253 latches the display data carried by display bus 83. Simultaneously, output enable 126 triggers the output 272 of latch 252 so that latch 252 causes the character display to display column two, as shown at 282. This display by latch 252 occurs for the duration of the strobe pulse 85 connected to column decoder 120 so that the display of the selected column enabled by output enable 126 occurs for a very short interval sufficient enough, however, to allow the associated feedback circuit 292 to read the status of the signal elements or pixels in display column and to provide this information on feedback bus 84 so that the data is returned to controller 18 for testing the integrity of the display.

From the foregoing, it should be appreciated that the address data carried by address bus 81 addresses allows controller 18 to address the specific character display associated with a logic circuit having a unique character address therefore. This allows the logic circuits to be located in close proximity to its respective character display with the controller located distantly from the character display. Once a logic circuit is addressed, its associated character display is disabled, and the latches 251–255 are activated sequentially to latch the column or "addressed set" data then residing on data bus 83. Thus, controller 18 addresses a selected logic circuit and then cycles through all of its column latches to load the appropriate display data in each latch according to the row in the column. Between strobe pulses, the controller selects a new column and alters the data for that column.

By disabling the overall character display, the character display is blank. After loading one column into its respective data latch, controller 18 addresses a subsequent column. At this time, though, output enable 126 activates that data latch for a preceding column which is already been loaded so that the data latch is enabled to display, for the duration of the strobe pulse, the feedback data derived from the monitoring of the signal elements corresponding to the preceding column. This feedback data may be processed by the controller to compare the feedback data from the intended signal display data for that column to determine whether it is valid. In other words, when data corresponding to the desired on/off states for each signal element in a selected column is being latched, a different column is being tested for integrity of the previously latched data. As discussed below, not only does this allow for testing of the integrity of the display data, but also allows an operator to selectively and remotely test to determine the proper functioning of the signal elements and their associated switches which comprise the entire message display.

Figure 15:
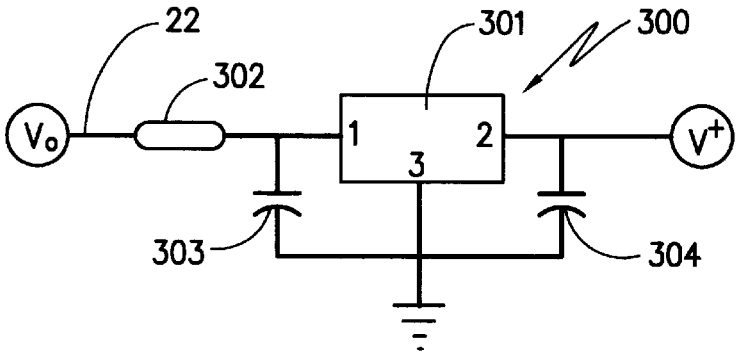
FIG. 15 is a diagrammatic view showing the power supply for the logic circuit of FIG. 14.

With reference to FIG. 15, it may be seen that the voltage to drive logic circuit 40 may be obtained from the power voltage "$V_o$" provided over power line 22. Preferably $V_o$ is preferably approximately twenty-four volts DC, and it is desired to operate the logic circuit at "$V^+$" which is preferably about five volts DC. To derive $V^+$, a power supply circuit 300 is associated with each logic circuit 40 and includes a voltage divider 301 in the form of a circuit chip (LM7805) which receives the $V_o$ input through resistor 302 which is preferably 200 ohms. The input of chip 301 is grounded by means of capacitor 303 and the output of chip 301 is grounded by capacitor 304. Capacitors 303 and 304 are respectively 1.0 $\mu$f and 10 $\mu$f. With this configuration, chip 301 provides a five volt DC output as $V^+$.

Figure 16:
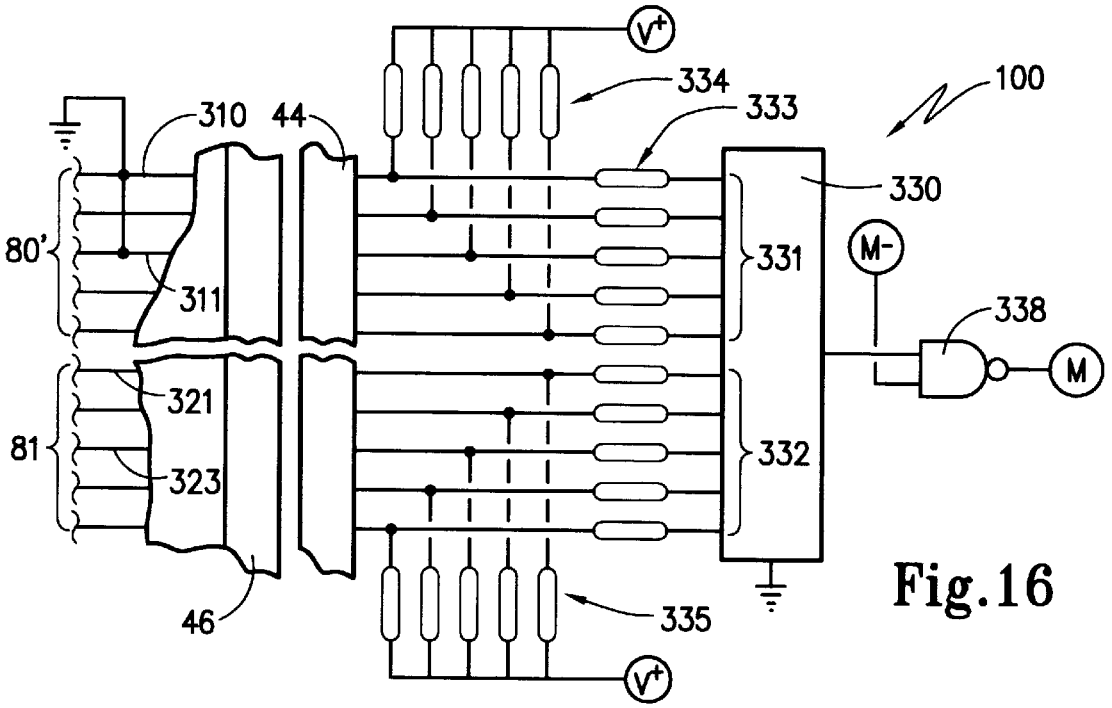
FIG. 16 is a circuit diagram of the address comparator of FIG. 14.

FIG. 16 shows hard wiring for the unique address and the functioning of address comparator 100. Here, it may be seen that connector 46 of interconnect cable 24 has a plurality of ground wires 80 which may be selectively severed to provide a binary pattern. Thus, leads 310 and 311 are connected to ground and inputs 80'can be thus configured to provide a unique address code at the address comparator inputs 331. Leads 81 of interconnect cable 24 allow controller 18 to place an address on address bus 81 by pulling down leads 321 and 323 to ground with the remaining leads remaining high due to the connection to $V^+$ through connector 44. Thus, when controller 18 places the appropriate address on leads 81, this character address data will match the hard wire address provided by connector 46.

Connector 46 is connectable to connector 44 of logic circuit 40 and provides the inputs for comparator chip 330 which is preferably a 74HC688 or any other comparable binary comparator. Inputs 331 and inputs 332 of chip 330 are connected to the pins of connector 44 by means of 10 k ohm resistors 333. The pins of connector 44 corresponding to inputs 331 are also connected to $V^+$ through 100 k ohm resistors 334 and the pins of connector 44 associated with inputs 332 of chip 330 are connected to $V^+$ by means of 10 k ohm resistors 335. When the hardware address on inputs 331 matches the controller address on pins 332, comparator 330 outputs a pair of signals M and $M^-$ which have opposite values from one another and which each switch to their opposite state depending on whether an address match occurs. If an address match occurs, the output $M^-$ of chip 33 is low; the opposite signal "M" is provided by NAND gate 338. Thus, M is high at $V^+$ when an address match occurs. When there is no address match, $M^-$ remains high and M is correspondingly low.

Figure 17:
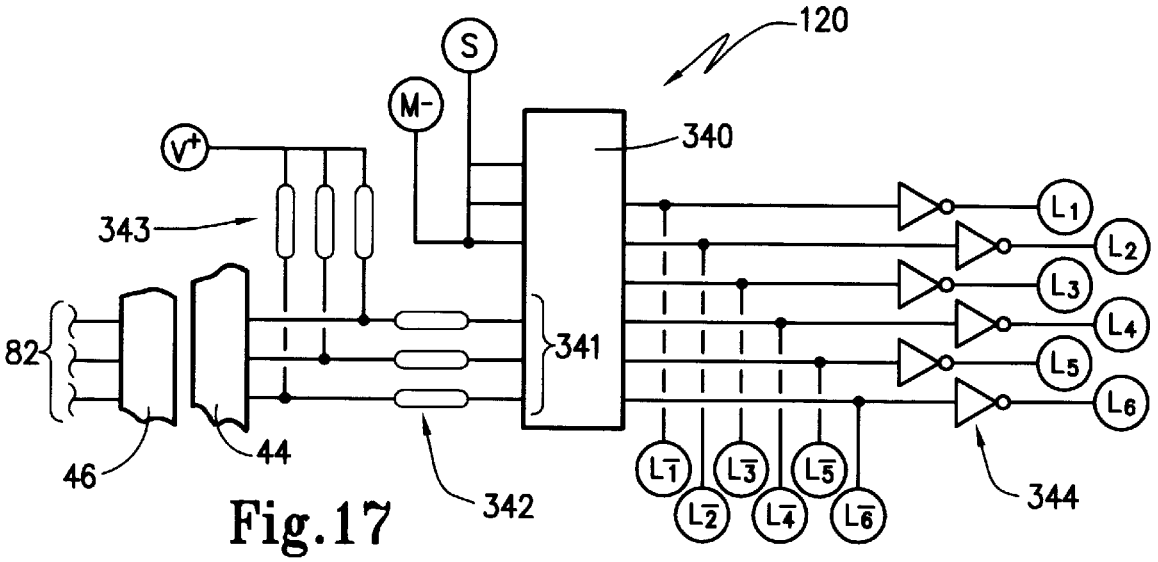
FIG. 17 is a circuit diagram of the column decoder of FIG. 14.

Turning to FIG. 17, column decoder 120 is shown to include a processing chip 340 which is preferably a 74HC138 microchip or equivalent decoder. Chip 340 has inputs 341 which receive the column address data from wires 82 by means of the connection of connector 44 to connector 46. Accordingly, inputs 341 are connected to the pins of connectors 44 through 10 k ohm resistors 342. The pins of connector 44 corresponding to inputs 341 are also connected to $V^+$ through 10 k ohm resistors 343. When both the strobe pulse S and the signal $M^-$ are present, chip 340 produces one of a possible six outputs $L_1$–$L_6$ depending upon the binary pattern from wires 82. Thus, where the respective logic circuit 40 is addressed, column decoder 120 acts to address a selected column in its associated character display according to the column address data. The outputs of chip 340 are high except for the decoded column which is pulled low. Inverters 344 invert the outputs of decoder chip 340 so that the addressed one of signals $L_1$–$L_6$ is at $V^+$ while all others of $L_1$–$L_6$ are low (ground). $L_1^-$ through $L_6^-$ are the complements of $L_1$–$L_6$.

Figure 18:
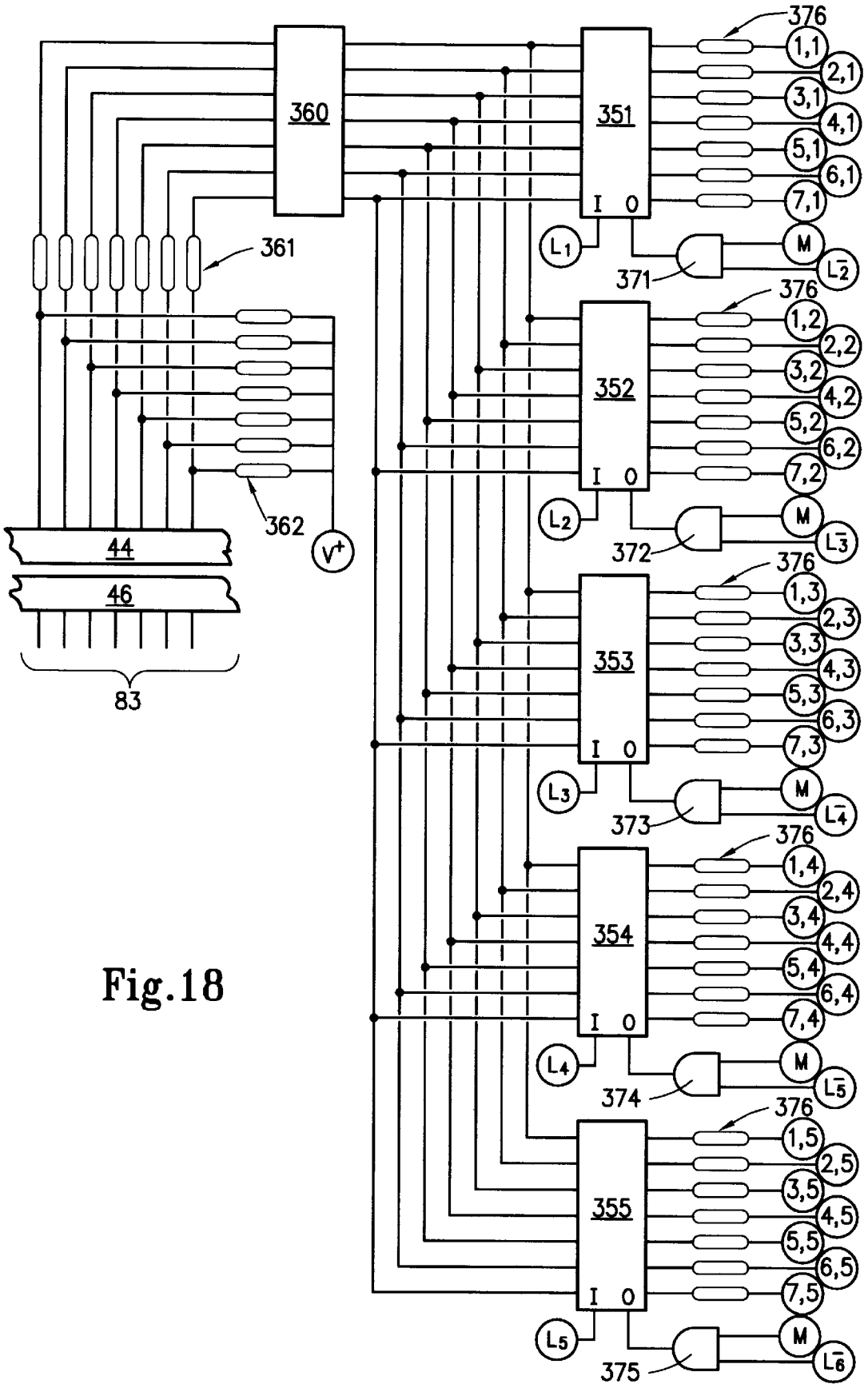
FIG. 18 is a circuit diagram of the input enable, output enable and column latches of FIG. 14.

FIG. 18 shows the operation of the data latches corresponding to each column. Depending upon which of outputs $L_1$–$L_6$ is generated by column decoder 120, that high signal is applied to the input respectively of data latches 351–355. The seven inputs of each of data latches 351–355 are connected to the outputs of buffer chip 360 which may be a 74HC540 or equivalent microchip. The inputs of buffer 360 are connected to the corresponding pins of connector 44 through 10 k ohm resistors at 361, and the corresponding pins of connector 44 are also connected to $V^+$ by means of 10 k ohm resistors 362. Data carried by data bus 83 accordingly passes through buffer 360 and is presented to each of data latches 351–355. However, only the data latch corresponding to the activated column signal $L_1$–$L_6$ acts to latch the data, with the column pulse only occurring for the duration of the strobe. As noted below, $L_6^-$ is used only for feedback.

For example, if column three is to be addressed, column decoder 120 produces high on $L_3$ and a low on $L_1$, $L_2$, and $L_4$–$L_6$ so that the row data corresponding to the data on data bus 83 is latched at the input of data latch 353. Simultaneously, however, output $L_3$ is input into AND gate 372 so that the output of data latch 352 is activated to produce a switch signal for each signal element (1,2; 2,2; 3,2; 4,2; 5,2; 6,2; and 7,2) which signals correspond to the previously latched data when input enable signal $L_2$ was present. Latches 351–355 accordingly each have an AND gate 371–375 connected to its output enable. The switch signals are thus output through 2.2K ohm resistors 376 connected in series to the outputs of each of data latches 351–355.

As noted above, except for testing the integrity of previously latched column data, the character display corresponding to the addressed character is forced into an off state when it is receiving new address data. This is accomplished by the control circuit shown in FIG. 19 which includes an NAND gate 380 which has a first input connected to $V^+$ through a 10 k ohm resistor 381 and a 10 k ohm resistor 382 connected in series with one another. The inverted pulse width modulation signal from controller 18 is connected between resistors 381 and 382 so that, in the presence of the pulse switch modulation signal, the inverted pulse switch modulation signal goes low so that the first input of NAND gate 380 is low. The second input of NAND gate 380 is connected to the signal $M^-$. Thus, when the module is addressed, the output of NAND gate 380 is always high. However, when the module is not addressed, $M^-$ is high and the output of NAND gate 380 is the inverted $PW^-$ signal which is simply the same as PW, that is, the pulse width modulation signal from controller 18. The output of NAND gate 380 is connected to the gate of transistor 390 through 750 ohm resistor 391. When this output is low, transistor remains in an off condition but transistor turns on when the output of NAND gate 380 is high. The resulting control signal DP therefore switches according to the pulse modulation when the character module and its associated logic circuit is not addressed. When addressed, however, DP is always high so that the feedback will operate. Preferably the pulse-width modulation has a ten millisecond period and can be controlled for 0%–100% (full power). It should be understood that this can be adjusted as desired.

E. Feedback Circuitry

The present invention also includes new and useful feedback circuitry for the variable message display sign described above. In order to best understand the feedback circuitry, reference is first made to FIG. 20 which is a diagram of a portion of a character display as above described. Here, each signal element 50,50' is defined by a first diode array 60,60' connected in series with resistor 70,70' and a second diode array 62,62' connected in series with a second resistor 72,72' with these two diode array circuits 60,62 and 60',62' being connected electrically in parallel to one another between a switched power source $V_o$ and ground. Switching is accomplished by means of a switch transistors 400,400' which have their collectors connected to a respective signal element 50,50' and their emitters connected to ground through an eighteen ohm resistor 401,401'. The base of each switching transistor 400,400' is connected to ground through a 10K ohm resistor 402,402'. Moreover, the base of transistor 400 is connected to the output 1,1 of latch device 351 while the base of transistor 400' is connected to output 2,1 of latch 351.

Figure 20:
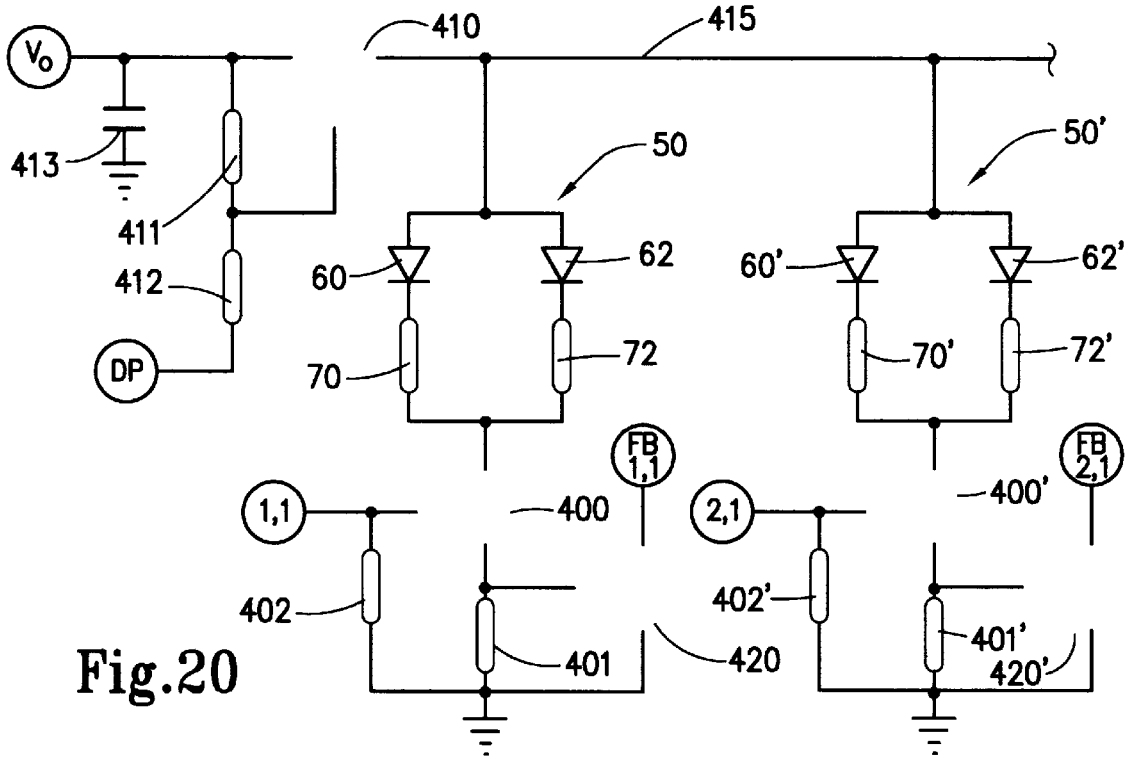
FIG. 20 is a generalized circuit diagram of a pair of pixels in a character display according to the present invention and showing the feedback capabilities.

Thus, it may be seen in reference to FIG. 20, that signal elements 50,50' correspond to the first row and the second row signal elements in column one of the associated character display. Signal elements 50,50' are connected in parallel to one another between ground and voltage $V_o$, and are connected to voltage $V_o$ through a switching transistor 410 which may be an MJE271 transistor. The base of transistor 410 is connected to $V_o$ through a 10K ohm resistor 411 and to pulse control signal "DP" through 10K ohm resistor 412. The collector of transistor 410 is directly connected to $V_o$ and also to ground through a 1000 micro-farad capacitor 413. Accordingly, when a pulse signal is present on the base of transistor 410, it turns on so that power is supplied to power line 415. Accordingly, when the switching transistors, such as transistors 400,400' are in an open state, the signal device 50,50' will remain off. However, in the presence of an enable input signal at 1,1 or 2,1, the respective switching transistor 400,400' will switch into a closed state completing the circuit-to-ground thereby allowing the respective signaling element 50,50' to move into an on-state when in an operative condition.

Feedback transistors, such as feedback transistor 420,420' have their respective bases connected to the emitters of switching transistors 400,400' and monitor the voltage present at the emitter. For example, if switching transistor 400 is in an open state, no voltage is present on the base of transistor 420 so that the output FB 1,1 remains high. However, if switch 400 is closed and switch element is operative, sufficient voltage is present on the base of transistor 420 so that it switches thereby allowing FB 1,1 to go low indicating that switch elements 50 are properly functioning. If one of the diode arrays 60, 62 ceases to function, such as the burnout of the one of the diodes in the associated diode array, then the resistance increases and the current through the circuit decreases. Thus, transistor 420 does not turn on and feedback signal FB 1,1 remains high. Likewise, should the switch element, such as switch transistor 400 fail by shorting, signal element 50 is always on and feedback FB 1,1 is always low regardless of the status of input signal 1,1.

Figure 21:
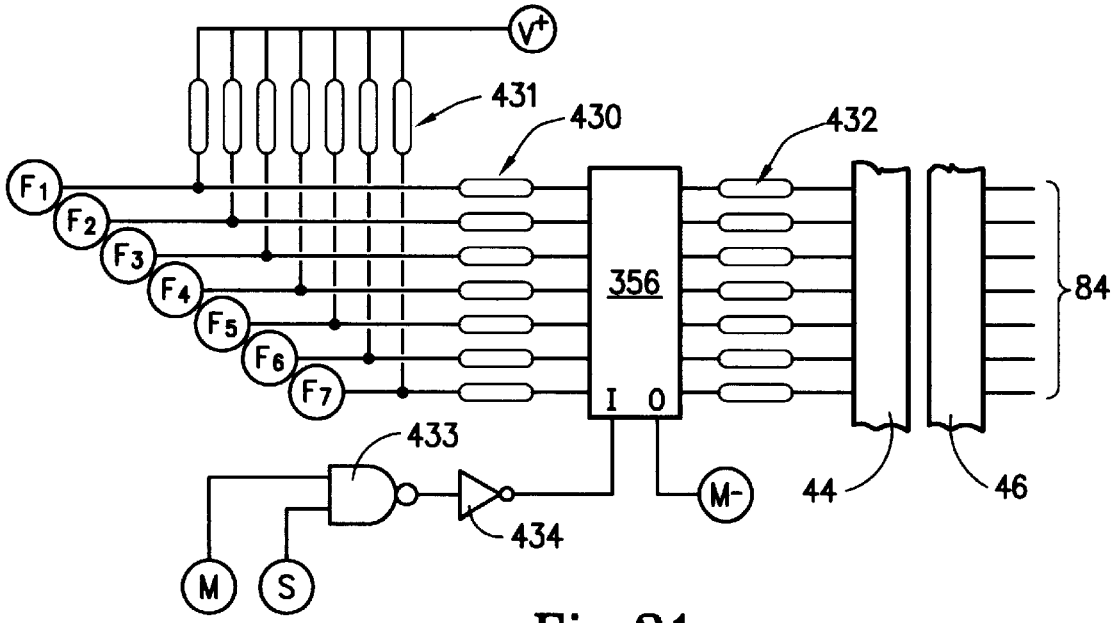
FIG. 21 is a circuit diagram of the feedback circuitry contained within the logic circuit of the present invention according to FIG. 14.
Figure 1:
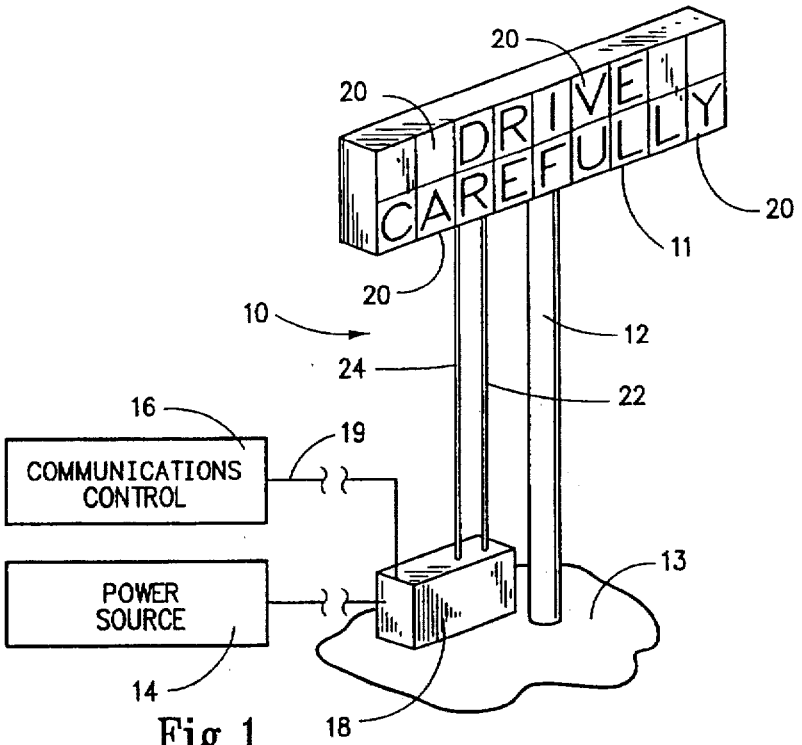
Figure 2:
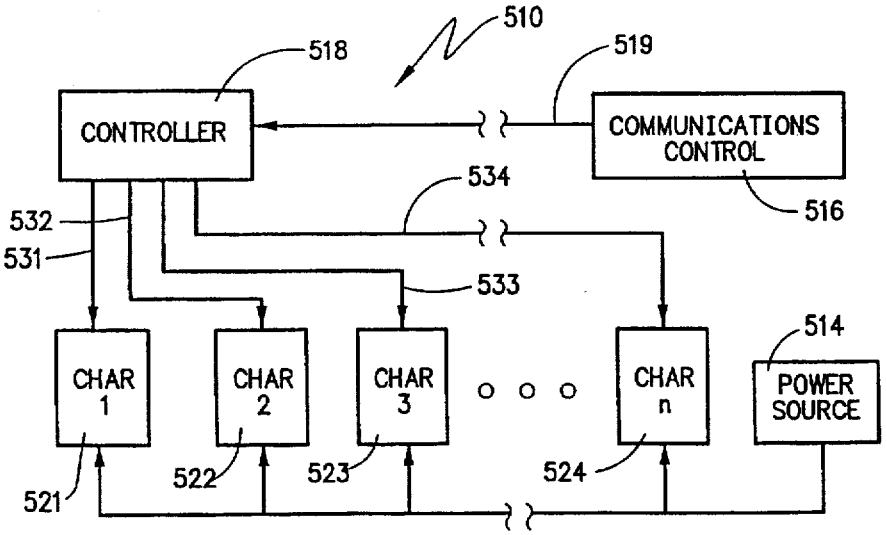
Fig.2 (PRIOR ART)
Figure 3:
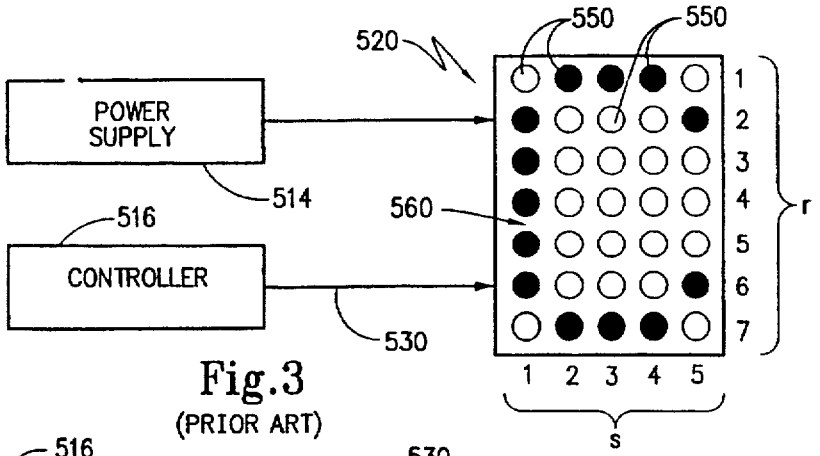
Fig.3 (PRIOR ART)
Figure 4:
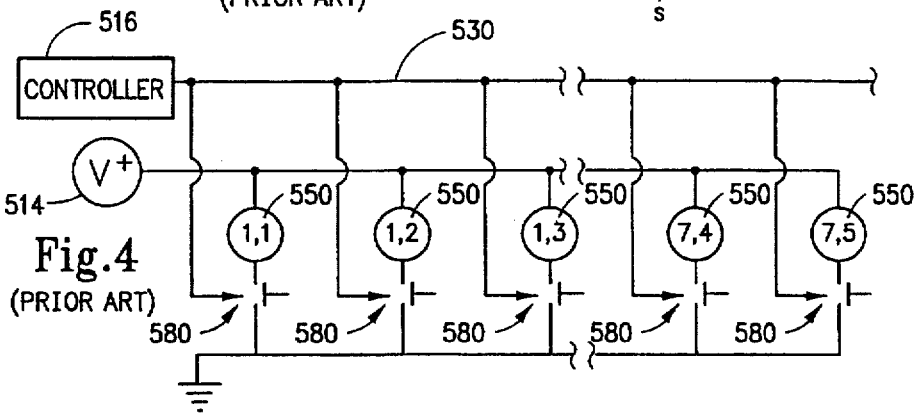
Fig.4 (PRIOR ART)
Figure 5:
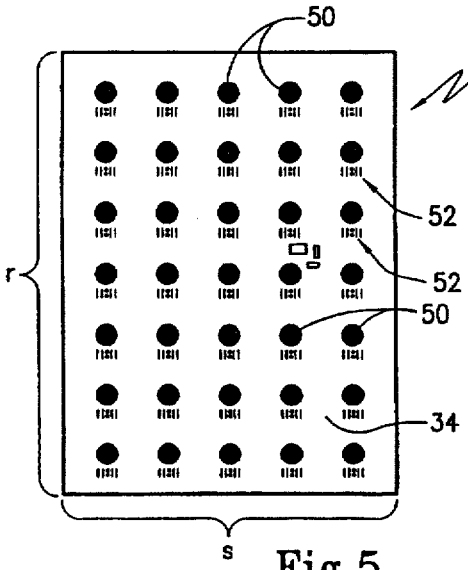
Figure 6:
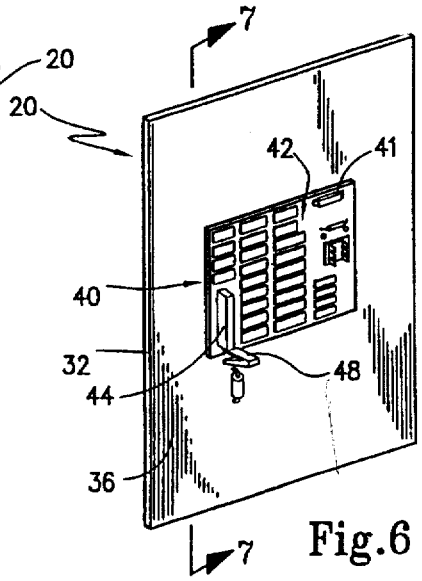
Figure 7:
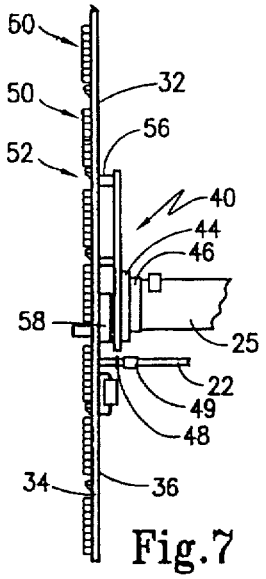
Figure 8:
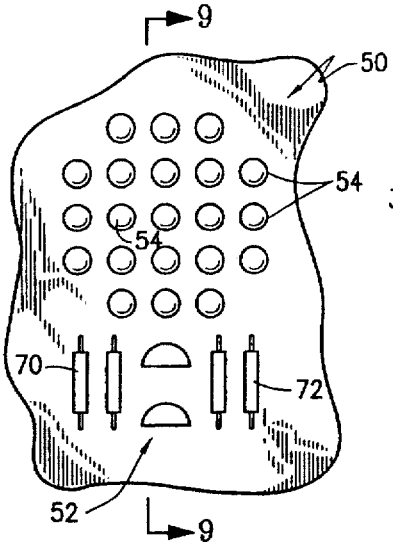
Figure 9:
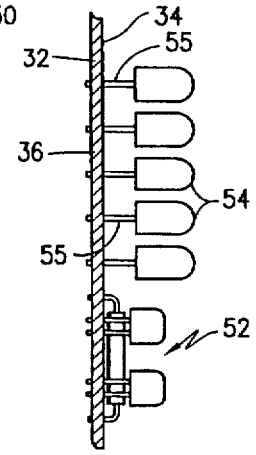
Figure 10:
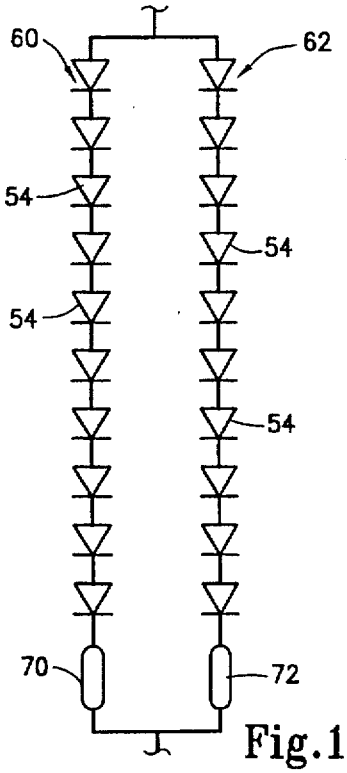
Figure 11:
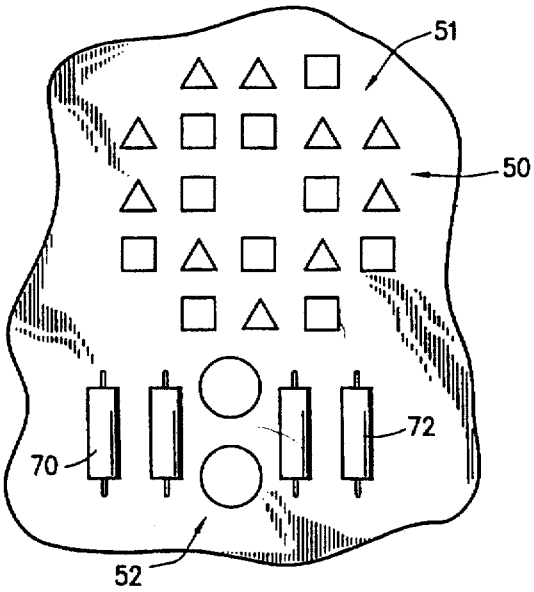
Figure 12:
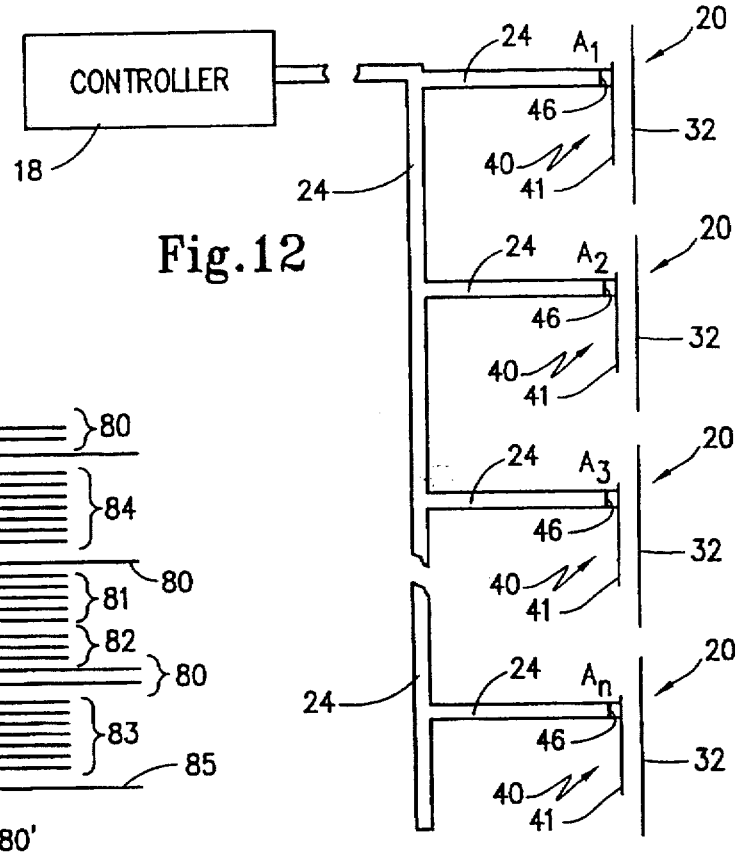
Figure 13:
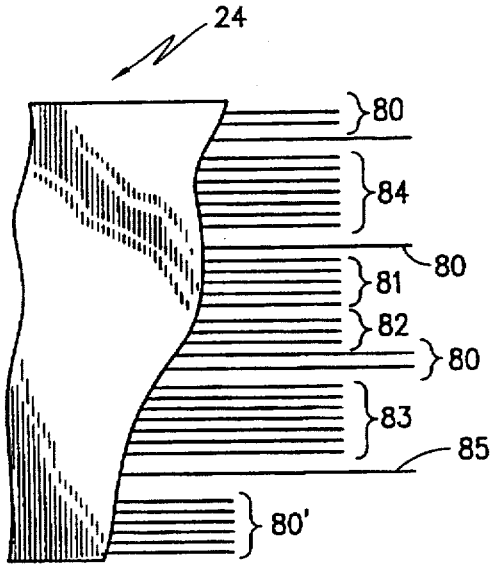
Figure 15:
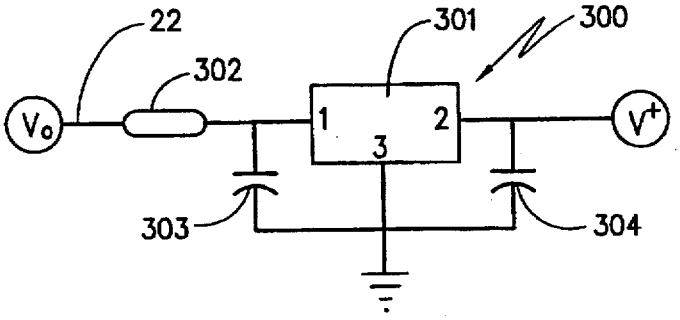
Figure 14:
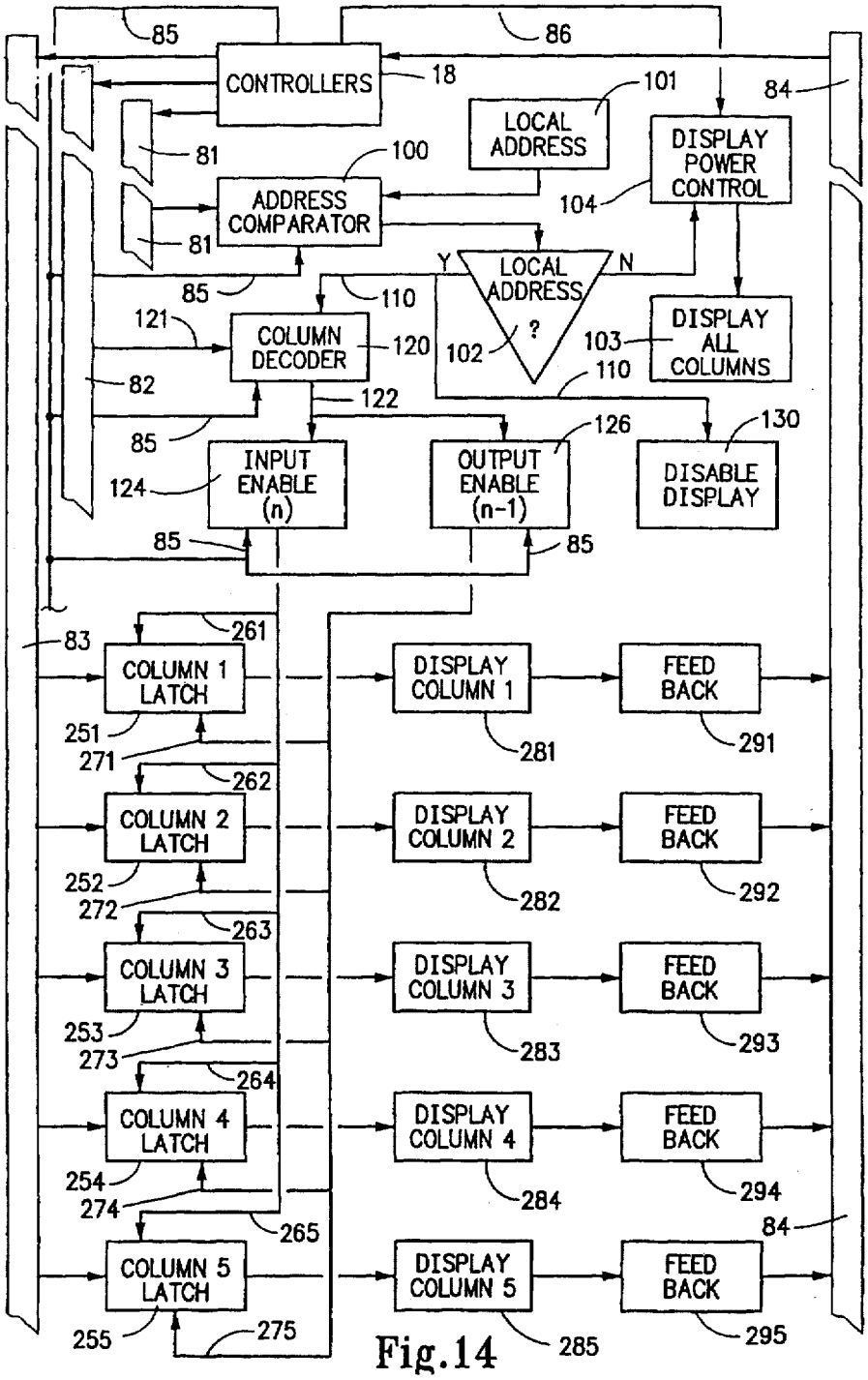
Figure 16:
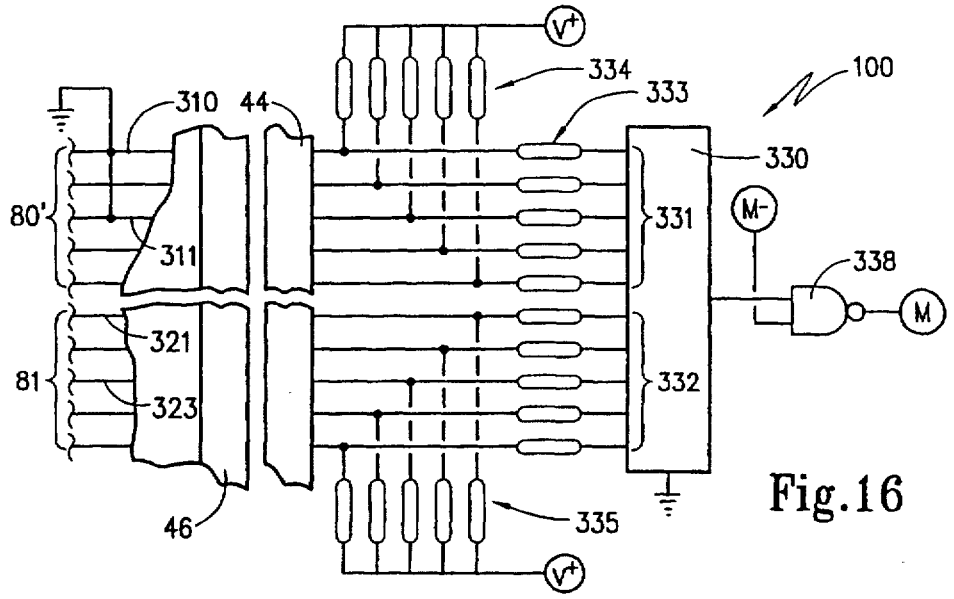
Figure 17:
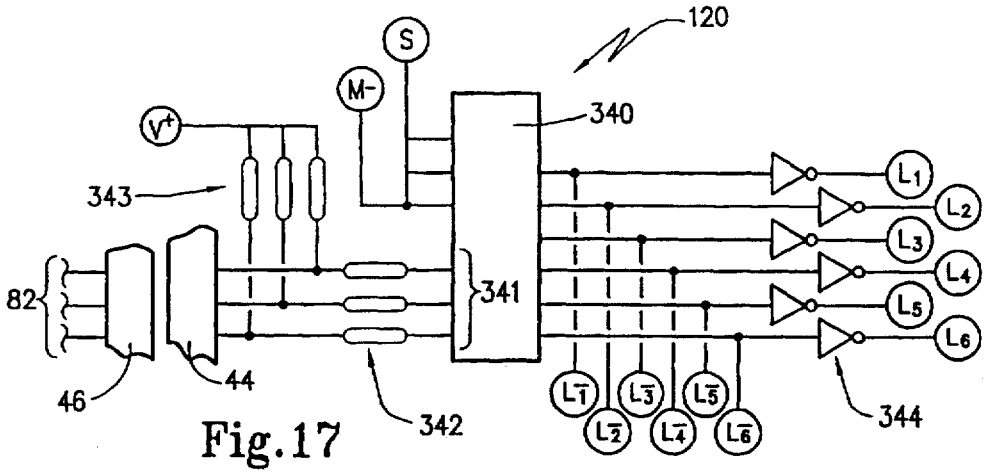
Figure 19:
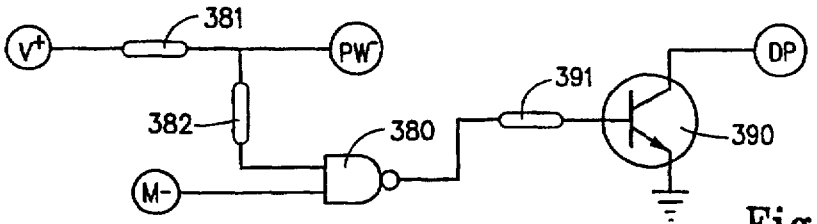
Figure 20:
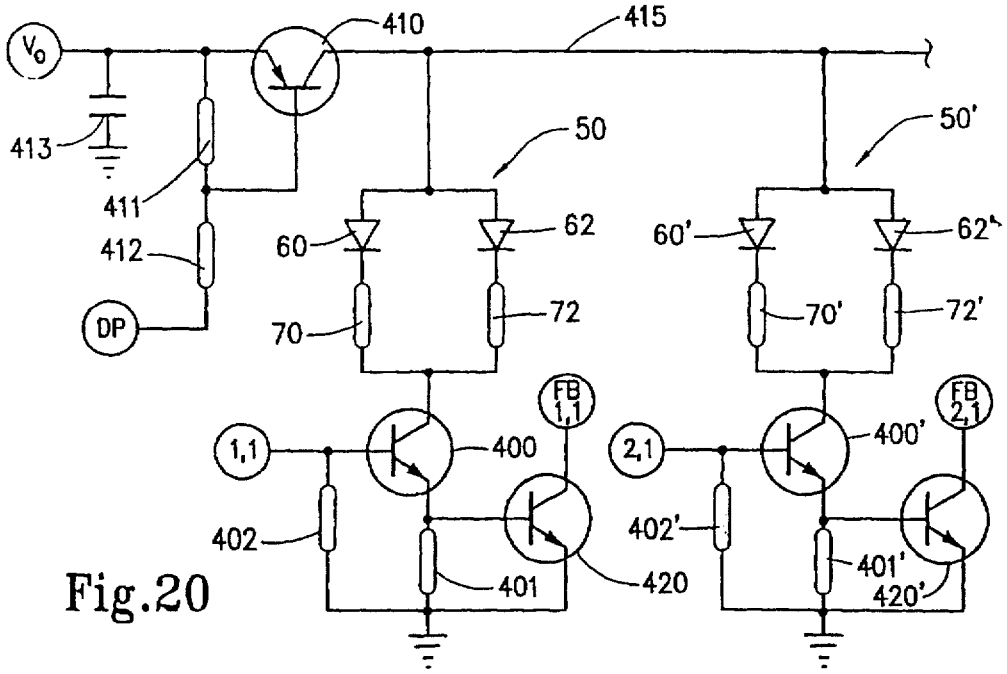
Figure 21:
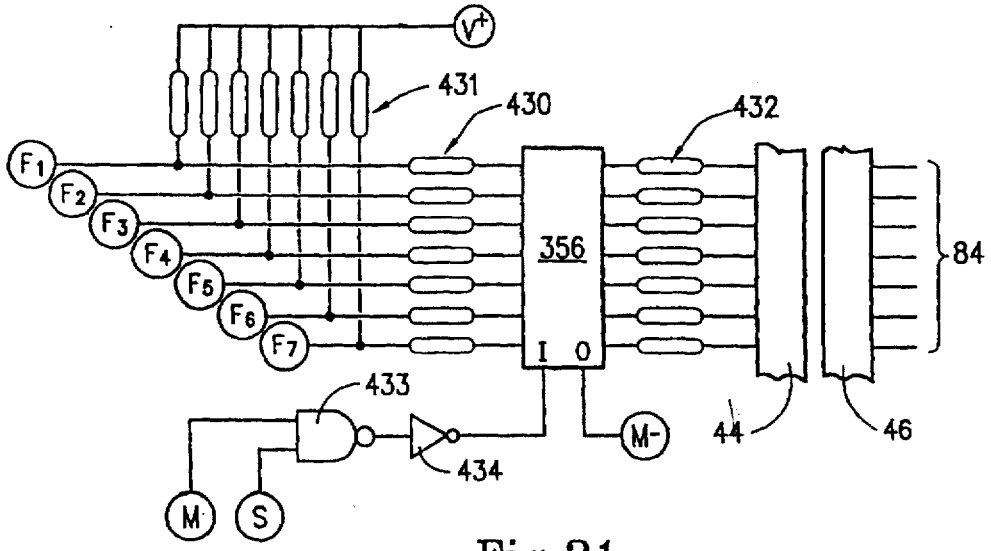

The outputs of the feedback transistors 420 for each given row are connected together to simplify the feedback circuit. The outputs of each feedback transistor in a given row, then, is represented as feedback signals $F_1$–$F_7$ in FIG. 21. Each of these signals is connected to the inputs of a feedback latch 356 through 10K ohm resistors 430 and respectively to $V^+$ through 100K ohm resistors 431. The outputs of feedback latch 356 are connected to connector 44 to the pins of connector 44 through resistors 432 to provide the feedback data connected to the pins of connector 46 and thus to feedback bus 84.

The output of latch 356 is disabled when the respective module is not addressed since $M^-$ is high. When the module is being addressed, $M^-$ is low. The output of NAND gate 433 is therefore low in the presence of strobe pulse "S" since M is high; the output is high in the absence of the strobe pulse. Inverter 434 inverts this signal, however, so that the resulting input enable to latch 356 is switched according to the strobe pulse when the module is addressed.

With reference again to the preferred exemplary embodiment described especially in reference to FIGS. 14–19, the integrity of the signaling devices of each pixel may be tested by causing controller 18 to sequentially blank each column of each character display while monitoring the feedback through feedback latch 356. If any signal element is improperly operating, the malfunction will appear on the row data containing the malfunctioning switch device for each column of that character display. Thus, the operator will know that one of the switch devices in the identified row is malfunctioning so that the character display module can be replaced and repaired.

On the other hand, controller 18 may sequentially instruct each column to light up each pixel in its corresponding rows. Here, the feedback signal will indicate whether any pixel is "burned-out" or of a diminished capacity (where parallel signal elements are employed). Should the feedback data indicate a high condition for the feedback transistor of a pixel, then the operator will know that the signal device occupying that column and row position is defective. Again, the character module may be replaced and repaired.

According to the general method of the present invention, a method for controlling a plurality of character displays is provided wherein each character display has a plurality of signal elements that are individually switchable between on and off states in order to produce a pattern of a desired character. These signal elements are organized in a plurality of sets, and the method comprises the control of these signal elements. The method includes the first steps of providing a logic circuit proximate to each character display with each logic circuit including a memory operative to store display data for each of the associated signal elements of each of its associated sets, providing a unique address for each such logic circuit, providing a controller for each logic circuit located remotely thereof and interconnecting the logic circuits and the controller by means of a common bus. The method further includes the step of placing a character address on the bus and comparing the character address with the unique addresses for each logic circuit so that an addressed one of the logic circuits is placed in a condition to receive display data with remaining ones of the logic circuits inhibited from receiving display data. A set address is also placed on the bus to identify a selected one of the sets of signal elements so that the memory associated therewith is placed in a condition to receive the display data with all other memories of the address logic circuit being inhibited from receiving display data. Also, display data is placed on the bus corresponding to each of the signal elements of the selected set, and the display data is loaded into the memory associated with the selected set of the address logic circuit. The steps of placing character address data, set address data and display data on the bus is then repeated until the memories of all of the logic circuits are loaded with display data for their respective character displays. Said character displays are, of course, powered so that the signal elements thereof are switched to display the pattern according to the display data.

Preferably, the steps of placing the character address, the set address and display data occurs simultaneously, and the method includes the step of providing a clock or strobe pulse which causes the data to be processed as described above. In between the clocking pulses, the controller acts to vary the display data as needed and the addressed logic circuit and/or set of signal elements. The method can include the inhibiting of any display of data by the character display associated with the addressed logic circuit. Also, the method may include the feedback to the controller of feedback test data wherein the integrity of the display pattern for each set of signal elements is compared with the intended display data for the signal elements of the selected set. Preferably, the method includes the step of loading display data for one set of signal elements while testing the data previously loaded for another set of signal elements. This method may also include any step inherently practiced by the apparatus and control circuitry described herein.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiment of the present invention without departing from the inventive concepts contained herein.

I claim:

1. A variable message display sign having a power source and operative to display a variable message, comprising:

(a) a plurality of interchangeable character displays each having a plurality of signal elements organized in a plurality of distinct sets, each said signal element having an on state and an off state;

(b) a controller located remotely from said character displays and operative to produce an address signal containing character address data for identifying an addressed character display which resides at a desired address location within said message display sign, a set signal containing set address data for identifying an addressed set of signal elements and a data signal containing display data corresponding to desired on/off states for each signal element in the addressed state;

(c) a logic circuit associated with each of said character displays and having a unique character address therefor, each said logic circuit secured to a respective one of said character displays and having a memory operative in response to the address signal containing character address data corresponding to the unique character address of said logic circuit to receive and store the display data according to the set address data for an addressed set of signal elements, said logic circuit operative to switch the signal elements of its associated character display to a desired pattern of an on/off states according to the display data stored in said memory thereby to display a desired character irrespective of which one of said plurality of character displays resides at the desired address location; and (d) a data bus interconnected said controller and said logic circuits whereby said character address data, said set address data and said display data is communicated.

2. A variable message display sign according to claim 1 wherein said signal elements are organized as a matrix having rows and columns, each of said distinct sets corresponding to a selected one of said rows and columns.

3. A variable message display sign according to claim 1 wherein said signal elements are selected from a group consisting of light emitting diodes, liquid crystals, shutter elements and electric bulbs.

4. A variable message display sign according to claim 1 wherein each of said character displays includes a support panel having a front surface and a rear surface, each said signal element on each of said character displays being a plurality of light emitting diodes disposed as a diode array on the front surface of said support panel and having diode leads directly secured to said support panel thereby to define pixels.

5. A variable message display sign according to claim 1 wherein each said signal element on each of said character displays being a plurality of light emitting diodes organized in at least two different groups electrically connected in parallel to one another with the light emitting diodes in each respective group electrically connected in series with one another, said light emitting diodes being arranged in a diode array having array columns and array rows, there being at least one light emitting diode from each of said groups in each of the array rows and in each of the array columns.

6. A variable message display sign according to claim 1 including a monitoring element associated with each respective signal element and operative to monitor the on/off state of the respective signal element and produce a feedback signal corresponding thereto, said data bus operative to communicate the feedback signal to said controller.

7. A variable message display sign according to claim 1 wherein said controller is interconnected to a communications system for receiving instructions therefrom whereby said controller acts to change a message displayed by said character displays.

8. A variable message display sign according to claim 1 wherein each of said character displays includes a display switch operative to activate its respective character display for a selected duration and frequency, said controller operative to produce a pulse width signal that controls the duration and frequency said display switches are activated.

9. A variable message display sign according to claim 1 wherein each said logic circuit includes a disable circuit operative in response to address data corresponding to its unique character address to prevent its character display from being activated while display data is being loaded into the memory thereof.

10. A variable message display sign according to claim 9 including a monitoring element associated with each respective signal element and operative to monitor the on/off state of the respective signal element and produce a feedback signal corresponding thereto, each said logic circuit including a disable override circuit operative to selectively activate a selected distinct set of signal elements in its character display while display data corresponding to a different distinct set of signal elements is being loaded into the memory thereof whereby a test feedback signal is produced for the selected distinct set of signal elements, said data bus operative to communicate the test feedback signal to said controller.

11. A variable message display sign according to claim 1 wherein each said logic circuit includes a comparator operative to compare the unique character address thereof with said address data.

12. A variable message display sign according to claim 1 where each said logic circuit includes a set decoder operative to decode the set signal to identify the addressed set of signal elements.

13. A variable message display sign according to claim 1 wherein said memory of each logic circuit is a data latch associated with each set of signal elements of its respective character display, each said data latch having latch inputs and latch outputs in numerical correspondence with the signal elements in its associated set.

14. A variable message display sign according to claim 1 wherein said character displays each include a support panel having a front surface and a rear surface, each said signal element on each said character display disposed on the front surface of said support panel and wherein each said logic circuit is mounted on a circuit board, said circuit board disposed on said support panel.

15. A variable message display sign having a power source and operative to display a variable message, comprising:

(a) a plurality of character displays operative to display a selected message, each said character display including a plurality of signal elements organized in a matrix having a plurality of rows and columns with each said signal element switchable between an on state and an off state;

(b) a controller located remotely from said character displays and operative to produce an address signal containing character data for identifying an addressed character display which resides at a desired address location within said message display sign, a column signal containing column address data for identifying an addressed column of signal elements within the addressed character display, a row data signal containing display data corresponding to desired on/off states for each signal element respectively occupying the rows in the addressed column and a strobe signal having periodic strobe pulses, said controller operative to selectively change the character address data, the column address data and the display instructions between strobe pulses when changing the selected message;

(c) a logic circuit associated with each of said character displays and having a unique character address therefor, each said logic circuit located proximately to a respective one of said character displays and including:

(1) an address comparator operative in response to a strobe pulse to compare the address data with the unique character address to determine a match condition indicating that its corresponding character display is being addressed, said address comparator operative in response to the match condition to generate a match signal, (2) a data latch associated with each respective column of the associated character display, each said data latch operative in response to an input enable signal and a strobe pulse to latch the display data and in response to an output enable signal to output the display latched therein, and (3) a column decoder operative in response to a strobe pulse and the match signal decode the column data and thereby to produce and communicate an input enable signal to a respective data latch corresponding to the addressed column, said logic circuit operative to produce an output signal for each said data latch signal in response to an absence of the match condition whereby said signal elements of its associated character display are switched to a desired pattern of on/off states according to the display data stored in said data latches thereby to display a desired character irrespective of which one of said plurality of character displays resides at said desired address location unique character address; and (d) a data bus interconnecting said controller and said logic circuits whereby said character address data, said set address data, said display data and said strobe pulses are communicated to said logic circuits.

16. A variable message display sign according to claim 15 including a monitoring element associated with each respective signal element and operative to monitor the on/off state of the respective signal element and produce a feedback signal corresponding thereto, said data bus operative to communicate the feedback signal to said controller.

17. A variable message display sign according to claim 16 wherein each said logic circuit is operative in response to the match signal to produce an output enable signal for a selected one of its data latches after the selected one has been loaded with its respective display data whereby said feedback signal is correlated to the signal elements corresponding to the selected one of its data latches.

18. A variable message display sign according to claim 15 wherein each of said character displays includes a display switch operative to activate its respective character display for a selected duration and frequency, said controller operative to produce a pulse width signal that controls the duration and frequency said display switches are activated.

19. A variable message display sign according to claim 15 wherein each of said logic circuits is interconnected to said data bus by way of a interconnect cable terminating in a first connector that is releasably connectable to a second connector associated with a respective logic circuit, said interconnect cable being hard wired with the unique character address whereby a logic circuit connected thereto resides at the unique character address of said interconnect cable.

20. A variable message display sign according to claim 15 wherein said character displays each include a support panel having a front surface and a rear surface, each said signal element on each said character display disposed on the front surface of said support panel and wherein each said logic circuit is mounted on a circuit board, said circuit board disposed on and supported by said support panel.

21. A method of controlling a plurality of interchangeable character displays each having a plurality of signal elements individually switchable between an on-state and an off-state to produce a pattern of a desired character, said signal elements being organized in a plurality of sets, comprising the steps of:

(a) providing a logic circuit proximate to each character display, each said logic circuit including a memory operative to store display data for each of the associated signal elements of each of its associated sets;

(b) providing a unique address for each logic circuit;

(c) providing a controller for said logic circuits located remotely thereof and interconnecting said logic circuits and said controller by a common bus;

(d) placing a character address on said bus and comparing the character address with the unique addresses for each said logic circuit so that an addressed one of said logic circuits which resides at a desired location within said message display sign is placed in a condition to receive display data, irrespective on which one of said plurality of character displays resides at the desired location, with remaining ones of said logic circuits inhibited from receiving display data;

(e) placing a set address on said bus identifying a selected one of said sets of signal elements so that the memory associated therewith is placed in a condition to receive display data with all other memories of the addressed logic circuit being inhibited from receiving display data;

(f) placing display data on said bus corresponding to each of the signal elements of the selected set and loading said display data in the memory associated with said selected set of the addressed logic circuit;

(g) repeating steps d, e and f until the memories of all of said logic circuits are loaded with display data for their respective character displays; and (h) powering said character displays so that the signal elements thereof are switched to display the pattern according to said display data.

22. A variable message display signal having a power source and operative to display a variable message, comprising:

(a) a plurality of interchangeable character displays each having a plurality of signal elements organized in a plurality of distinct sets, each of said signal elements having an on state and an off state;

(b) a controller located remotely from said character displays and operative to produce an address signal containing character address data for identifying an addressed character display which resides at a desired address location within said message display sign, a set signal containing set address data for identifying an addressed set of signal elements and a data signal containing display data corresponding to desired on/off states for each signal element in the addressed set; and (c) a logic circuit associated with each of said character displays and having a unique character address therefor, each said logic circuit being secured to a respective one of said character displays and having a memory operative in response to the address signal containing character address data corresponding to the unique character address of said logic circuit to receive and store the display data according to the set address data for an addressed set of signal elements, said logic circuit operative to switch the signal elements of its associated character display to a desired pattern of on/off states according to the display data stored in said memory thereby to display a desired character irrespective of which one of said plurality of character displays resides at the desired address location, each said logic circuit being interconnected to a data bus by way of an interconnect cable terminating in a first connector that is releasably connectable to a second connector associated with a respective logic circuit, said interconnect cable being hard wired with the unique character address whereby the logic circuit connected thereto resides at the unique character address of said interconnect cable, said data bus interconnecting said controller and said logic circuit whereby said character address data, said set address data and said display data are communicated to said logic circuit.

* * * * *

UNITED STATES PATENT AND TRADEMARK OFFICE

CERTIFICATE OF CORRECTION

PATENT NO. : 6,088,008
DATED : July 11, 2000
INVENTOR(S) : Bruce B. Reeder

Figure 19:
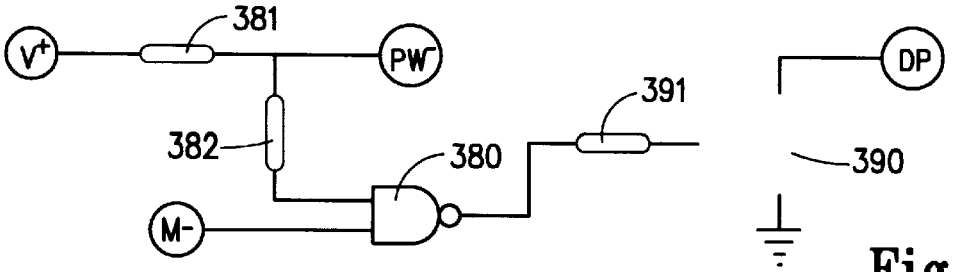
FIG. 19 is a circuit diagram of the display power control of FIG. 14.

It is certified that error appears in the above-identified patent and that said Letters Patent is hereby corrected as shown below:

Figure 2,
Directional arrow heads are missing for lines pointing to elements 521-524 identified as "CHAR 1", "CHAR 2", "CHAR 3" AND "CHAR n";

Figure 3,
Directional arrow heads are missing for lines pointing to display element 520, and bulb located at row "r2" and column "s5" should be filled in;

Figure 4,
Directional arrow heads missing for leader line identified by numbers "580";

Figure 7,
Leader line for number "58" is extended to identify multi-pin connect;

Figure 8,
Additional number "54" missing from center of the array;

Figure 13,
Address bus line is missing for "number 81" (identified in the specification on page 23, "five wires 81 form an address bus . . ..".);

Figure 14,
All directional arrow heads are missing from the drawing and leader line is missing for reference number 104;

Figure 19,
Transistor element is missing for reference number "390"; and

UNITED STATES PATENT AND TRADEMARK OFFICE

CERTIFICATE OF CORRECTION

PATENT NO. : 6,088,008
DATED : July 11, 2000
INVENTOR(S) : Bruce B. Reeder

It is certified that error appears in the above-identified patent and that said Letters Patent is hereby corrected as shown below:

Figure 20,
Transistor elements are missing for refernce numbers "410", "400", "420", "400'" and "420'".

Signed and Sealed this

Eighth Day of January, 2002

*Attest:*

*Attesting Officer*

JAMES E. ROGAN
*Director of the United States Patent and Trademark Office*